US010330374B2

(12) United States Patent
Park et al.

(10) Patent No.: US 10,330,374 B2
(45) Date of Patent: Jun. 25, 2019

(54) REFRIGERATOR, AND CONTROL METHOD THEREOF

(71) Applicant: Samsung Electronics Co., Ltd., Suwon-si (KR)

(72) Inventors: Kyoung Ki Park, Yongin-si (KR); Hyun Hee Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/718,427

(22) Filed: Sep. 28, 2017

(65) Prior Publication Data

US 2018/0100685 A1 Apr. 12, 2018

(30) Foreign Application Priority Data

Oct. 6, 2016 (KR) ..... 10-2016-0129136
Dec. 27, 2016 (KR) ..... 10-2016-0179831

(51) Int. Cl.

| | |
|---|---|
| ***F25D 23/12*** | (2006.01) |
| ***F25D 23/02*** | (2006.01) |
| ***B67D 1/08*** | (2006.01) |
| ***F25D 11/02*** | (2006.01) |
| ***F25C 5/20*** | (2018.01) |
| *B67D 1/00* | (2006.01) |

(52) U.S. Cl.

CPC ..... *F25D 23/126* (2013.01); *B67D 1/0858* (2013.01); *F25C 5/22* (2018.01); *F25D 11/02* (2013.01); *F25D 23/028* (2013.01); *B67D 1/0004* (2013.01); *B67D 2001/0092* (2013.01); *B67D 2210/00036* (2013.01); *F25C 2600/04* (2013.01)

(58) Field of Classification Search

CPC ..... F25D 23/126
See application file for complete search history.

(56) References Cited

U.S. PATENT DOCUMENTS

2006/0065006 A1* 3/2006 Park ..... F25C 5/22 62/344
2006/0144075 A1* 7/2006 Bowen ..... F25D 23/126 62/344
2006/0201193 A1 9/2006 Bowen et al.
2008/0121667 A1* 5/2008 Park ..... F25D 23/126 222/477

(Continued)

FOREIGN PATENT DOCUMENTS

JP 2009-270818 11/2009
KR 10-2006-0070183 6/2006
KR 10-2006-0075894 7/2006

(Continued)

OTHER PUBLICATIONS

International Search Report dated Jan. 19, 2018 in International Patent Application No. PCT/KR2017/010793.

*Primary Examiner* — J C Jacyna
(74) *Attorney, Agent, or Firm* — Staas & Halsey LLP

(57) ABSTRACT

A refrigerator includes an outlet opening/closing system for a refrigerator dispenser including a driver, a cam configured to rotate with respect to a first axis by the driver, and an opening/closing module configured to pivot with respect to a second axis according to the rotation of the cam to open the outlet, wherein the first axis crosses the second axis at a predetermined angle.

23 Claims, 26 Drawing Sheets

(56) References Cited

U.S. PATENT DOCUMENTS

| | | | | |
|---|---|---|---|---|
| 2010/0089492 | A1* | 4/2010 | Dirnberger | F25C 5/24<br>141/351 |
| 2013/0146612 | A1* | 6/2013 | Sanchez | B67D 7/56<br>222/28 |

FOREIGN PATENT DOCUMENTS

| | | |
|---|---|---|
| KR | 10-2011-0006868 | 1/2011 |
| KR | 10-2016-0086304 | 7/2016 |

* cited by examiner

REFRIGERATOR, AND CONTROL METHOD THEREOF

CROSS-REFERENCE TO RELATED APPLICATIONS

This application claims the priority benefit of Korean Patent Application No. 10-2016-0129136, filed on Oct. 6, 2016 in the Korean Intellectual Property Office, and Korean Patent Application No. 10-2016-0179831, filed on Dec. 27, 2016 in the Korean Intellectual Property Office, the disclosures of which are incorporated herein by reference.

BACKGROUND

1. Field

The following description relates to a refrigerant having a dispenser, and a control method thereof.

2. Description of the Related Art

In general, a refrigerator is a home appliance including a storage chamber for storing food and a cool air supply apparatus for supplying cool air to the storage chamber to keep the food fresh. Recently, many refrigerators are released with a dispenser to enable a user to obtain water or ice cubes from the refrigerator from outside the refrigerator without opening a door of the refrigerator, in order to meet a user's demand.

SUMMARY

A refrigerator having a dispenser can discharge water or ice cubes produced therein to the outside through an outlet. An outlet opening/closing system of the refrigerator may open or close the outlet by rotating a motor. More specifically, the motor and a cam connected to the motor may rotate to operate an opening/closing module included in the outlet opening/closing system, thereby opening or closing the outlet.

More specifically, the opening/closing module may pivot with respect to an axis to open or close the outlet. At this time, the rotary motion of the motor may be converted into the reciprocating motion of the lever by the cam so that the opening/closing module can pivot with respect to the axis (hereinafter, also referred to as a pivot axis).

That is, the cam may be connected to the rotation axis of the motor to perform an eccentric motion with respect to the rotation axis of the motor, and the lever may perform a reciprocating motion according to the eccentric motion of the cam, so that the opening/closing module can pivot with respect to the pivot axis.

In this structure, the rotation axis of the motor and cam may be parallel to the pivot axis of the opening/closing module, and accordingly, the diameter of the motor or the diameter of the cam may influence the total thickness of the outlet opening/closing system, which limits the slimness of the outlet opening/closing system.

Also, because the lever needs to have a specific range of motion of a predetermined distance or more in order for the opening/closing module to smoothly open or close the outlet, the cam for operating the lever may need to have a predetermined size or larger. The size of the cam may also limit the slimness of the outlet opening/closing system.

An embodiment of the present disclosure provides a slim opening/closing system by changing the structure of a cam and the position of a motor.

Additional aspects of the disclosure will be set forth in part in the description which follows and, in part, will be obvious from the description, or may be learned by practice of the disclosure.

In accordance with an aspect of the present disclosure, an outlet opening/closing system of a refrigerator dispenser comprises a driver; a cam configured to rotate with respect to a first axis by the driver; and an opening/closing module configured to pivot with respect to a second axis according to the rotation of the cam to open the outlet, wherein the first axis crosses the second axis at a predetermined angle.

The outlet opening/closing system may further comprise a support member, wherein the opening/closing module may be pivotally coupled with the support member.

The driver may be coupled with the support member.

The outlet opening/closing system nay further comprises a spring, wherein the spring may provide the opening/closing module with a force of closing the outlet.

The first axis may be at right angles to the second axis.

The cam may include a cam surface and a circumference surface, wherein a first protrusion and a second protrusion are formed on the circumference surface of the cam.

The first protrusion and the second protrusion may be spaced apart from each other and arranged at a predetermined angle with respect to each other.

The outlet opening/closing system may further comprise a first switch module and a second switch module, wherein the first protrusion may operate the first switch module and the second switch module.

The outlet opening/closing system may further comprise a first switch module and a second switch module, wherein the second protrusion may operate the second switch module.

The cam surface may include a first flat surface, a second flat surface, a first inclined surface, and a second inclined surface, and the first flat surface and the second flat surface may have different heights.

The first protrusion may be formed on an area of the circumference surface, adjacent to the first flat surface, and the second protrusion may be formed on another area of the circumference surface, adjacent to the first inclined surface.

The opening/closing module may include a lever, and a protrusion may be formed on one side of the lever, and may contact the cam surface of the cam.

The lever may be integrated into the opening/closing module.

If the protrusion contacts the first flat surface, the opening/closing module may open the outlet maximally, and the first protrusion may operate the first switch module and the second switch module.

If the protrusion contacts the second flat surface, the opening/closing module may close the outlet.

The lever may be located at the upper area of the opening/closing module with respect to a center line dividing the opening/closing module in half.

The protrusion of the lever may include a spherical surface.

The lever may pivot the opening/closing module with respect to the second axis by a difference in height of the cam surface.

When the cam rotates one time, the opening/closing module may pivot from a closed state to an opened state and then again pivot to the closed state.

The cam surface of the cam may be formed to move the lever in a tangential direction of a circle whose center is on the second axis.

The second flat surface may maintain the opening/closing module in a closed state for a predetermined time period although the cam rotates.

The first flat surface may maintain the opening/closing module in an opened state for a predetermined time period although the cam rotates.

The driver may further include a reduction gear.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
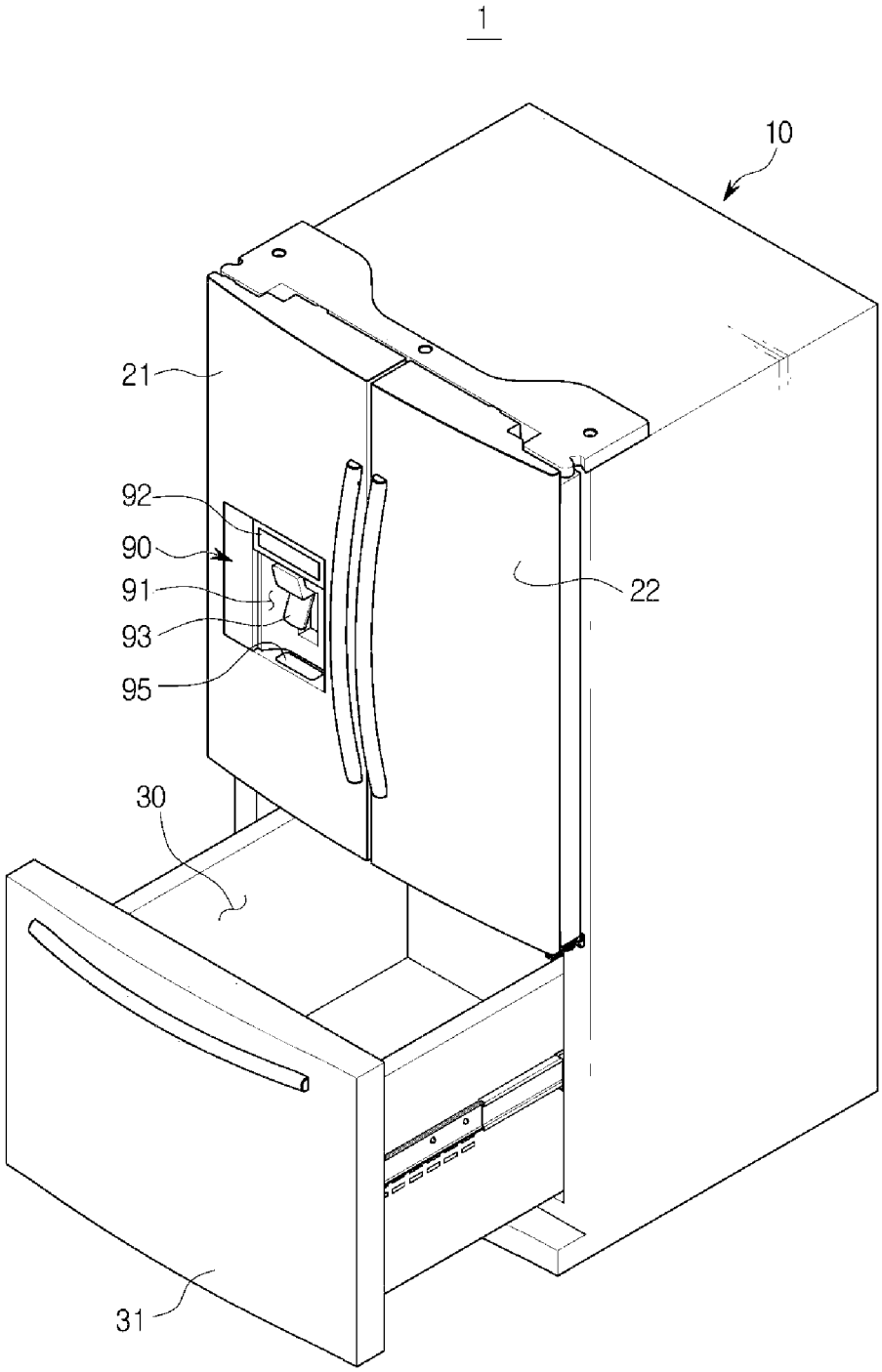
FIG. 1 shows the outer appearance of a refrigerator according to an embodiment of the present disclosure.

Hereinafter, embodiments of the present disclosure will be described in detail with reference to the accompanying drawings. In the drawings, like reference numerals represent members that perform the substantially same functions.

FIG. 1 shows the outer appearance of a refrigerator according to an embodiment of the present disclosure.

Figure 2:
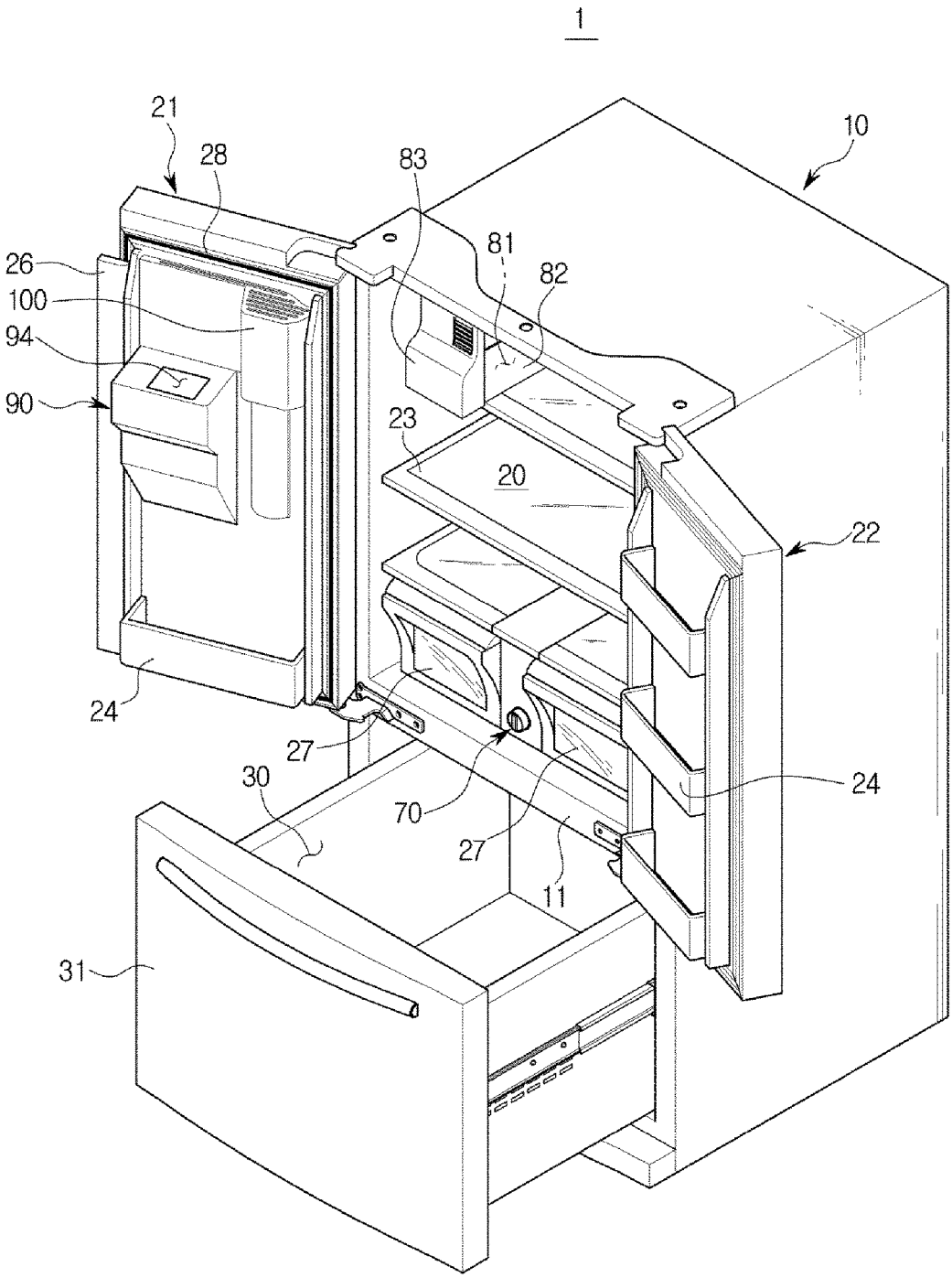
FIG. 2 shows the inside of the refrigerator according to an embodiment of the present disclosure.

FIG. 2 shows the inside of the refrigerator according to an embodiment of the present disclosure.

Figure 3:
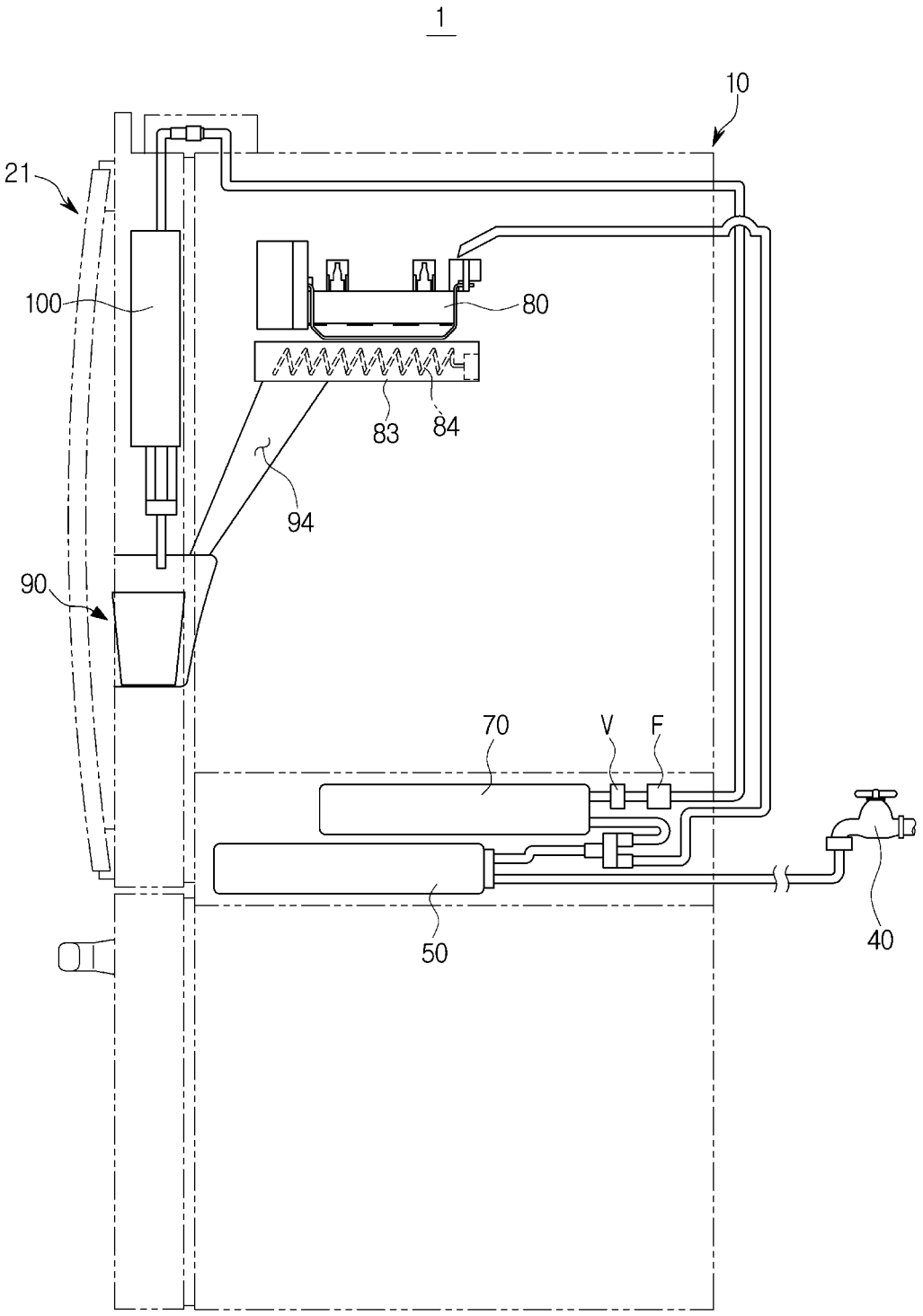
FIG. 3 is a side cross-sectional view of the refrigerator according to an embodiment of the present disclosure.

FIG. 3 is a side cross-sectional view of the refrigerator according to an embodiment of the present disclosure.

Figure 4:
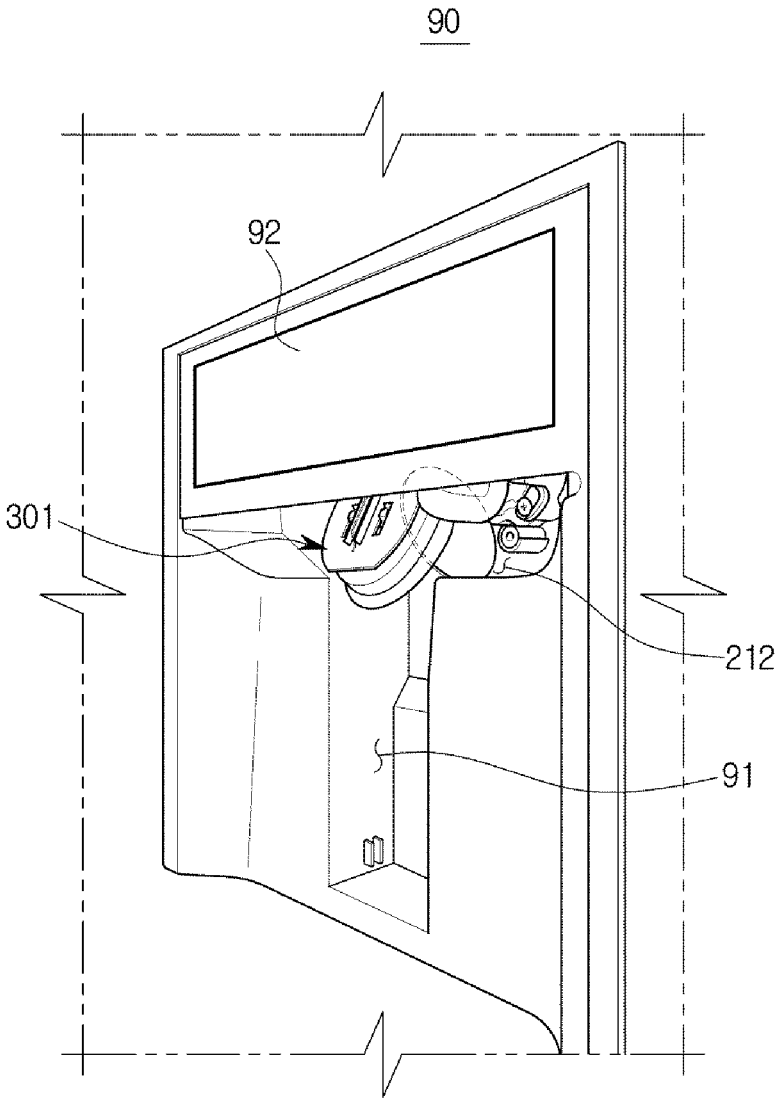
FIG. 4 is an enlarged view of a dispenser of the refrigerator.

FIG. 4 is an enlarged view of a dispenser of the refrigerator.

The following description will be given with reference to all of FIGS. 1 to 4 in order to avoid duplication of description.

A refrigerator 1 is equipment to keep objects at a low temperature. More specifically, the refrigerator 1 is equipment to maintain the temperature of a storage chamber at a user's desired level or less by evaporating and compressing refrigerant repeatedly, in order to store objects at a low temperature.

First, the outer appearance of the refrigerator 1 will be described. Referring to FIGS. 1 and 2, the refrigerator 1 may include a main body 10, a plurality of storage chambers 20 and 30 formed inside the main body 10, and a cooling apparatus (not shown) configured to supply cool air to the storage chambers 20 and 30. The cooling apparatus may include an evaporator, a compressor, a condenser, and an expander in order to evaporate and compress refrigerant cyclically.

Meanwhile, the main body 10 may include an inner case (not shown) forming the storage chambers 20 and 30, an outer case (not shown) coupled with the outer portion of the inner case and forming the outer appearance of the refrigerator 1, and an insulator (not shown) disposed between the inner case and the outer case and configured to insulate the storage chambers 20 and 30.

For example, the storage chambers 20 and 30 may be partitioned into a refrigerating chamber 20 which is the upper chamber and a freezing chamber 30 which is the lower chamber, by a partition wall 11. Meanwhile, the storage chambers 20 and 30 may be disposed vertically, unlike FIG. 2 in which the storage chambers 20 and 30 are disposed horizontally. That is, the storage chambers 20 and 30 may be disposed in various ways known in the related art.

Meanwhile, the refrigerating chamber 20 may be maintained at about 3° C. to keep food refrigerated, and the freezing chamber 30 may be maintained at about −18.5° C. to keep food frozen. In the refrigerating chamber 20, one or more shelves 23 on which food can be placed, and one or more storage boxes 27 to airtightly store food may be disposed.

Meanwhile, the front portions of the refrigerating chamber 20 and the freezing chamber 30 may open to enable a user to put and take food. The opened front portion of the refrigerating chamber 20 may be opened or closed by a pair of rotating doors 21 and 22 hinge-coupled with the main body 10, and the opened front portion of the freezing chamber 30 may be opened or closed by a sliding door 31 that can slide with respect to the main body 10. On the rear surfaces of the refrigerating chamber doors 21 and 22, a door guide 24 may be provided to store food.

Also, in the edges of the rear surfaces of the freezing chamber doors 21 and 22, a gasket 28 may be provided to seal space between the refrigerating chamber doors 21 and 22 and the main body 10 when the refrigerating chamber doors 21 and 22 close so as to prevent cool air from leaking out of the refrigerating chamber 20. Also, in any one refrigerating chamber door 21 of the refrigerating chamber doors 21 and 22, a rotating bar 26 may be provided to seal space between the refrigerating chamber doors 21 and 22 when the refrigerating chamber doors 21 and 22 close so as to prevent cool air from leaking out of the refrigerating chamber 20.

Also, an ice-making room 81 for making ice cubes may be provided in the upper corner of the refrigerating chamber 20. The ice-making room 81 may be partitioned from the refrigerating chamber 20 by an ice-making room wall 82.

The refrigerator 1 may include an ice supply module to discharge ice cubes produced by an ice maker 80 to intake space 91, an ice-making supply module to control a chute connected to the intake space 91, and a purified-water supply module 100 to supply water.

Referring to FIG. 3, in the ice-making room 81, the ice maker 80 to produce normal ice cubes or carbon-dioxide ice cubes, an ice bucket 83 to store the normal ice cubes or carbon-dioxide ice cubes produced in the ice maker 80, and an auger 84 to transfer the normal ice cubes or carbon-dioxide ice cubes stored in the ice bucket 83 to the chute 94 may be installed. The ice-making supply module may control operation of producing ice cubes through the above-mentioned components, and discharging the produced ice cubes through the auger 84.

Herein, the normal ice cubes may refer to ice cubes made by freezing normal water containing no carbon dioxide, and the carbon-dioxide ice cubes may refer to ice cubes made by freezing carbon-dioxide water containing carbon-dioxide. Also, the normal water may refer to water purified by the purified-water supply module which will be described later, and the carbon-dioxide water may refer to water containing carbon dioxide. In the following description, normal water and carbon-dioxide water will be collectively referred to as water when they do not need to be distinguished from each other, and also, normal ice cubes and carbon-dioxide ice cubes will be collectively referred to as ice cubes when they do not need to be distinguished from each other.

Meanwhile, the refrigerating chamber 20 may include a water tank 70 to store water. The water tank 70 may be located between the plurality of storage boxes 27, as shown in FIG. 2, although not limited to this. However, the water tank 70 may be located at any position inside the refrigerating chamber 20, as long as it can cool water stored therein through cool air inside the refrigerating chamber 20.

The water tank 70 may be connected to an external water source 40 such as a water pipe, as shown in FIG. 3, and store water purified through a purifying filter 50. Meanwhile, a water supply hose connected to the water tank 70 may include a water valve V. Accordingly, the refrigerator 1 according to an embodiment of the present disclosure may adjust a degree of opening of the water valve V to adjust the amount of water supplied through an outlet 303 via a flow path. Also, the power supply hose may include a flow sensor F to measure the amount of water that is supplied.

The purified-water supply module may supply water that is to be discharged through the outlet 212 of a dispenser 90, or supply water to a carbon-dioxide water supply module for producing carbon-dioxide water. The purified-water supply module may control the water tank 70 to store purified water, a purifying filter 50 to purify water supplied from the external water source 40, the water valve V to distribute purified water to the ice-making room 81 or the water tank 70 and to adjust the amount of water, and the flow sensor F to measure the amount of water that is to be supplied to the ice maker 80 or the carbon-dioxide water supply module, thereby supplying water.

Meanwhile, in any one refrigerating chamber door 21 of the refrigerating chamber doors 21 and 22, the dispenser 90 may be disposed to enable a user to take water or ice cubes from the outside without opening the refrigerating chamber door 21. However, the dispenser 90 may be positioned at any other location, instead of the front portion of the refrigerator 1 as shown in FIG. 1, as long as it can provide the user with various information visually at the location.

The dispenser 90 may include the intake space 91 into which the user can insert a container to fill water or ice cubes in the container, one or more input buttons to enable the user to manipulate various settings of the dispenser 90, an interface 92 to display various information related to the dispenser 90, and a lever 93 to operate the dispenser 90 to discharge water or ice cubes. Also, the dispenser 90 may include a container support 95 to support a container to receive water or ice cubes.

The container support 95 may be fixed at a predetermined location. Or, the container support 95 may be movable in up, down, left, and right directions. For example, if a container is put on the container support 95, the refrigerator 1 may control a motor included in the container support 95 to move the container support 95 to a position close to the outlet 212, thus preventing water or ice cubes discharged from the outlet 212 from splashing out of the container.

Also, the container support 95 may fix a container placed thereon to prevent the container from escaping from the container support 95. For example, a groove may be formed in the upper surface of the container support 95, and the groove may be formed as an elastic member. Accordingly, if the user inserts a container into the groove, the container can be fixed.

Also, the container support 95 may include a motor as described above. Accordingly, if it is sensed that a container is positioned in the groove formed in the container support 95, the refrigerator 1 may adjust the shape of the container support 95 through the motor so that the container can be fixed in the groove.

Meanwhile, as described above, the interface 92 may be disposed on the front portion of the refrigerator 1. For example, the interface 92 may be implemented as a display. The display may be one of various kinds of displays well-known in the related art, such as a Liquid Crystal Display (LCD), a Light Emitting Diode (LED) display, a Plasma Display Panel (PDP) display, an Organic Light Emitting Diode (OLED) display, a Cathode Ray Tube (CRT) display, or the like, although not limited to these. That is, the interface 92 may be any device that can display a user interface capable of visually displaying various information related to the refrigerator 1 and receiving various control commands from the user.

The refrigerator 1 according to an embodiment of the present disclosure may display, on the interface 92, a user interface configured to receive various control commands related to the refrigerator 1 from the user, as well as providing various information for the user.

In the dispenser 90, the intake space 91 may be formed in an accommodating groove of the refrigerating chamber door 21. In the intake space 91, a lever (not shown) that generates a discharge command signal when it is manipulated by a user who intends to take water or ice cubes may be provided. Also, in the dispenser 90, the outlet 212 may be provided to discharge at least one of water and ice cubes when the lever is manipulated. However, the dispenser 90 may discharge at least one of water and ice cubes when receiving a supply command through the interface 92.

Also, as shown in FIG. 4, the dispenser 90 may include an opening/closing module, or outlet cover, 301 to open or close the outlet 212.

Figure 5A:
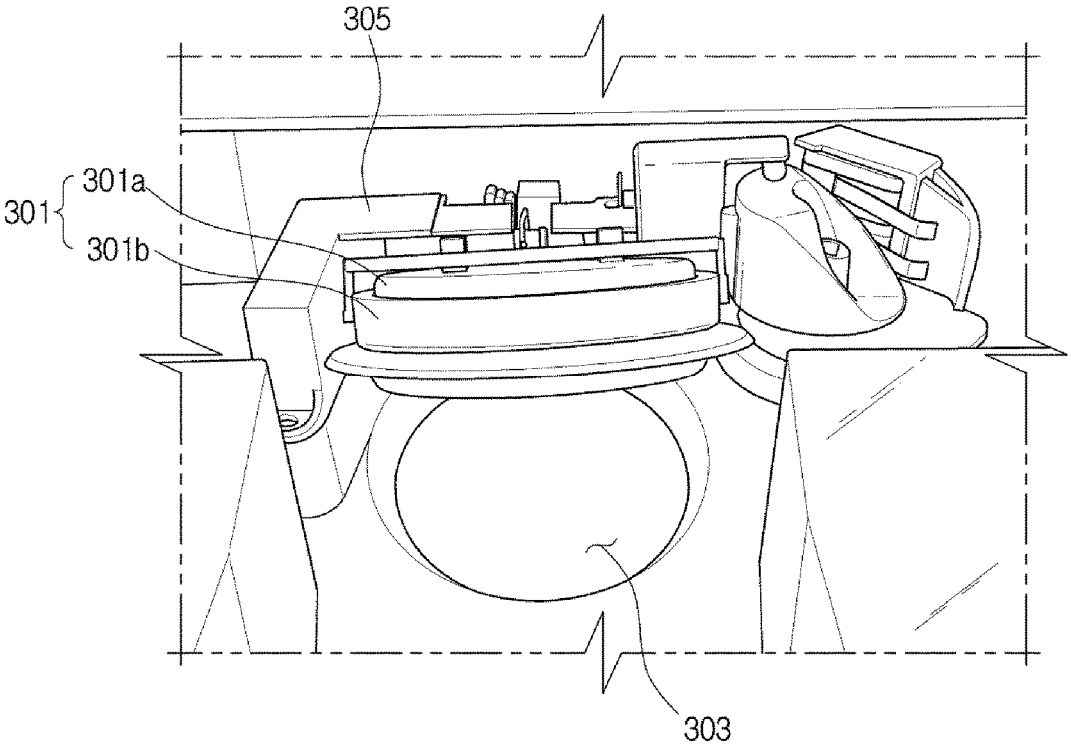
FIGS. 5A and 5B are enlarged views showing the outlet and the opening/closing module of the dispenser.
Figure 5B:
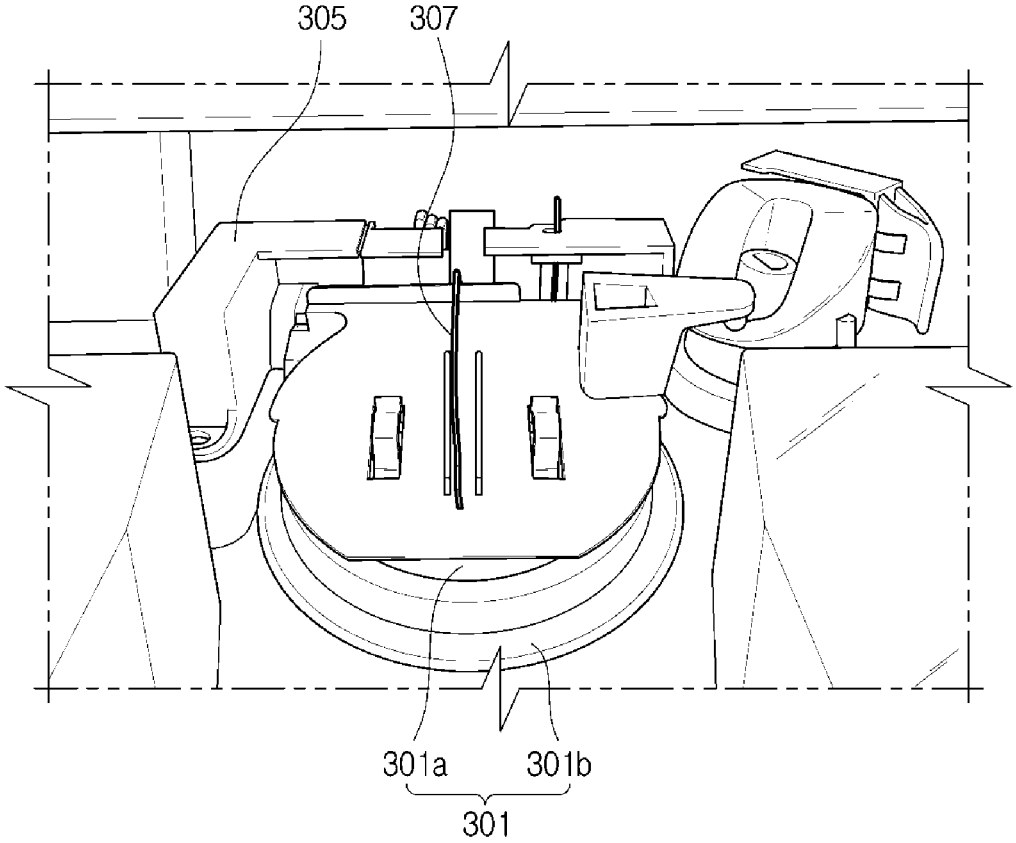

FIGS. 5A and 5B are enlarged views showing the outlet and the opening/closing module of the dispenser.

In FIG. 5A, the outlet 303, the opening/closing module 301, and a support member 305 are shown.

The opening/closing module 301 may be pivotally coupled with the support member 305 to open or close the outlet 303.

FIG. 5A shows a state in which the opening/closing module 301 opens.

The opening/closing module 301 may include a cap 301*a* and a gasket 301*b*. The gasket 301*b* may be formed of, for example, a rubber material to be able to tightly close the outlet 303. According to embodiments, the opening/closing module 301 may be configured with only the cap 301*a*, or with the cap 301*a* and the gasket 301*b* integrated into one body.

In FIG. 5B, the opening/closing module 301, the support member 305, and a spring 307 are shown. FIG. 5B shows a state in which the opening/closing module 301 closes the outlet 303.

The spring 307 may be installed in the opening/closing module 301 to apply a force in a direction of closing the opening/closing module 301. The opening/closing module 301 can be maintained in a closed state by the spring 307.

Figure 6:
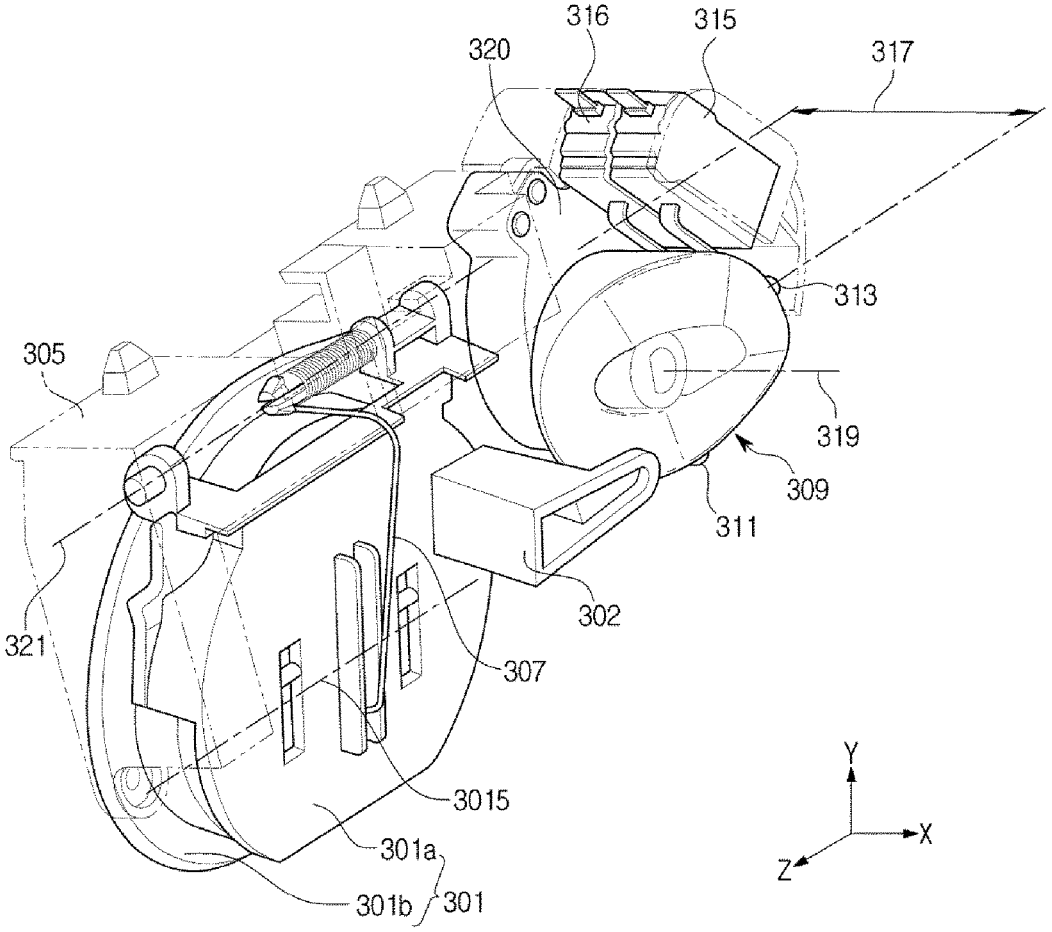
FIG. 6 shows an outlet opening/closing system of opening or closing the outlet of the dispenser in the refrigerator according to an embodiment of the present disclosure.

FIG. 6 shows an outlet opening/closing system of opening or closing the outlet of the dispenser in the refrigerator according to an embodiment of the present disclosure.

Referring to FIG. 6, the outlet opening/closing system may include a driver 320, a cam 309 rotating with respect to a first axis 319 by the driver 320, and the opening/closing module 301 pivoting in a direction 322 with respect to a second axis 321 according to the rotation of the cam 309 to open the outlet 303, wherein the first axis 319 crosses the second axis 321 at a predetermined angle. The predetermined angle may be, for example, in the range of 45 degrees to 135 degrees. Details about the opening/closing module 301, the support member 305, and the spring 307 have been described above with reference to FIGS. 5A and 5B, and accordingly, further descriptions thereof will be omitted.

The opening/closing system may include the support member 305.

The opening/closing module 301 may be pivotally coupled with the support member 305 to be able to pivot with respect to the second axis 321. That is, a hole may be formed in the support member 305, and a protrusion formed at the upper end of the opening/closing module 301 may be inserted into the hole, so that the opening/closing module 301 can pivot with respect to the second axis 321. Details about the operation will be described later with reference to FIG. 16.

The opening/closing module 301 may include a lever 302.

The lever 302 may be integrated into the opening/closing module 301, or fabricated as a separate member and then attached on the opening/closing module 301. In one side of the lever 302, a protrusion may be formed, and the protrusion may include a spherical surface. The protrusion may contact the cam 309. The spherical surface may minimize a contact area of the protrusion to the cam 309 to thus reduce friction. As the cam 309 rotates, the surface area of the cam 309 contacting the protrusion may change so that the lever 302 can move in a direction that is vertical to the cam surface due to a difference in height of the cam surface. As the lever 302 moves due to the difference in height of the cam surface, the opening/closing module 301 may pivot with respect to the second axis 321.

The lever 302 may be located at the upper area of the opening/closing module 301 with respect to a center line 3015 dividing the opening/closing module 301 in half horizontally. If the lever 302 is attached close to the second axis 321 (also, referred to as a pivot axis 321), the opening/closing module 301 can move greatly even when the lever 302 moves a little. Accordingly, it is possible to reduce the maximum height of the cam 309, which leads to a reduction of the total thickness 317 of the opening/closing system.

The cam 309 may rotate in a clockwise direction with respect to the first axis 319 by the driver 320. The cam 309 may have a shape obtained by cutting a cylinder at a predetermined angle, and include a cam surface. The cam surface may include a surface whose height changes according to the rotation angles of the cam 309 with respect to the first axis 319 as a rotation axis. That is, as the cam 309 rotates, the lever 302 may move in the direction that is vertical to the cam surface, due to the difference in height of the cam surface.

The cam 309 may include a first protrusion 313 and a second protrusion 311. The second protrusion 311 may operate only a second switch module 316, and the first protrusion 313 may operate both a first switch module 315 and the second switch module 316. Details about the operation will be described in more detail, later.

The opening/closing module 301 may be pivotally coupled with the support member 305 to be able to pivot with respect to the second axis 321. Also, the driver 320, the first switch module 315, and the second switch module 316 may be coupled with the support member 305. The shape and structure of the support member 305 will be described later with reference to FIG. 18.

The first switch module 315 and the second switch module 316 will be described in detail with reference to FIG. 14, later.

The driver 320 may be coupled with the support member 305, as described above.

The driver 320 may include a motor. According to an embodiment, the driver 320 may be a motor. According to an embodiment, the driver 320 may further include a reduction gear (not shown). The cam 309 may be connected directly to the motor or connected to the motor through the reduction gear to rotate.

The first axis 319 which is the rotation axis of the cam 309 may be not parallel to the second axis 321 which is the pivot axis of the opening/closing module 301, and may cross the second axis 321 at a predetermined angle. For example, the first axis 319 may be at right angles to the second axis 321.

More specifically, in order to prevent the diameters of the motor 320 and the cam 309 having a predetermined size or more from influencing the thickness 317 of the opening/closing system, the diameters of the cam 309 and the motor 320 may be disposed on a y-z plane. If the diameters of the cam 309 and the motor 320 are disposed on the y-z plane, the rotation axis 319 of the cam 309 and the motor 320 may cross the pivot axis 321 of the opening/closing module 301 at a predetermined angle.

Because the difference in height of the cam surface formed in the cam 309 can move the lever 302 in a direction that is similar to a rotation vector direction of the opening/closing module 301, the height difference as if it is even small can open the opening/closing module 301 enough. That is, it is possible to reduce the height of the cam 309 directly influencing the difference in height of the cam surface, which leads to a reduction of the total thickness 317 of the opening/closing system, resulting in the slimness of the dispenser 90.

Figure 7A:
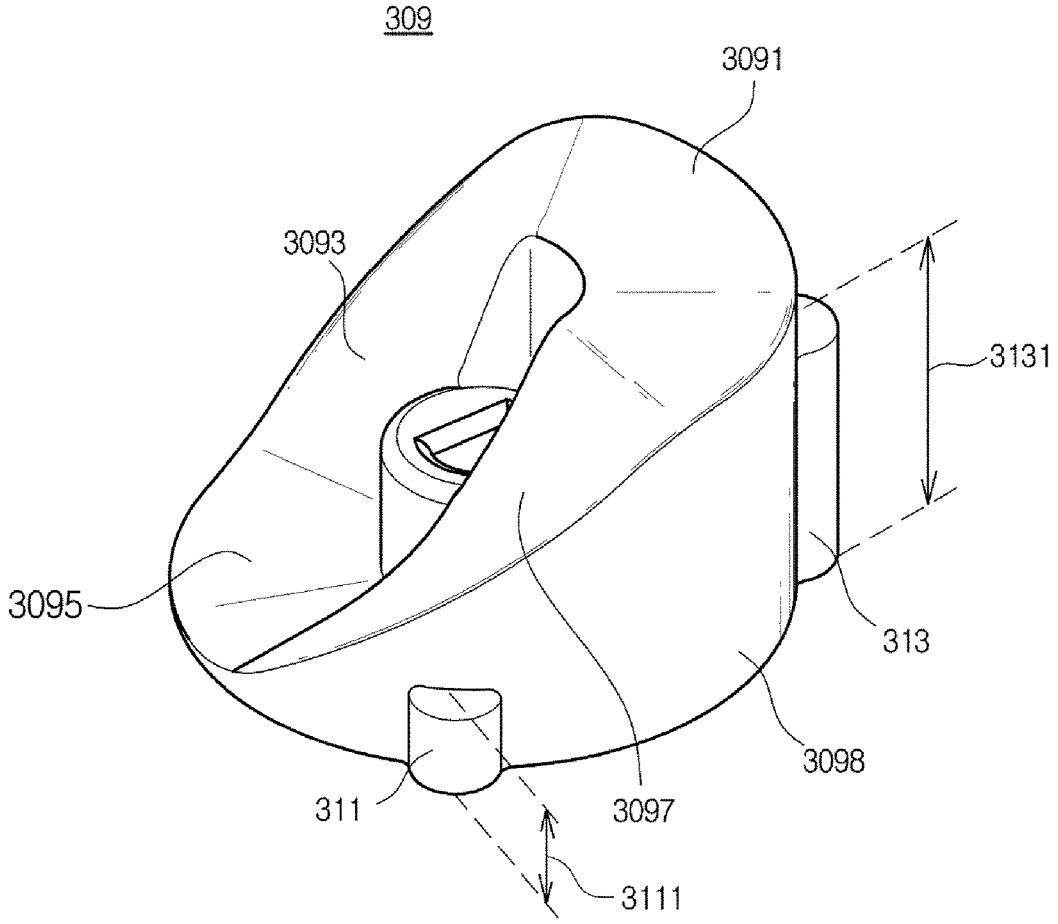
FIG. 7A is a perspective view of the cam.

FIG. 7A is a perspective view of the cam.

Referring to FIG. 7A, the cam 309 may include a plurality of cam surfaces 3091, 3093, 3095, and 3097, and a circumference surface 3098. On the circumference surface 3098, the first protrusion 313 and the second protrusion 311 may be formed. The first protrusion 313 and the second protrusion 311 may be formed on the circumference surface 3098 of the cam 309 in such a way to be spaced apart from each other and arranged at a predetermined angle with respect to each other. For example, the first protrusion 313 and the second protrusion 311 may be arranged at 60 degrees with respect to each other, although not limited to this.

The cam surfaces 3091, 3093, 3095, and 3097 may include a first flat surface 3091, a first inclined surface 3097, a second flat surface 3095, and a second inclined surface 3093. The first flat surface 3091, the first inclined surface 3097, the second flat surface 3095, and the second inclined surface 3093 may be connected to each other.

The first protrusion 313 may be formed on an area of the circumference surface 3098, adjacent to the first flat surface 3091. The second protrusion 311 may be formed on another area of the circumference surface 3098, adjacent to the first inclined surface 3097.

The first flat surface 3091 may be at a highest height from the bottom surface of the cam 309, and the second flat surface 3095 may be at a lowest height from the bottom surface of the cam 309. That is, there is a height difference between the first flat surface 3091 and the second flat surface 3095.

In order to move the lever 302 to the upper surface of the cam 309 with a small force and smoothly move the lever 302 to the lower surface of the cam 309, while reducing the circumference of the cam 309, the first inclined surface 3097 and the second inclined surface 3093 may have predetermined angles. For example, the first inclined surface 3097 may have a gradient of about 40 degrees with respect to the bottom surface of the cam 309, and the second inclined surface 3093 may have a gradient of about 30 degrees with respect to the bottom surface of the cam 309.

The length 3131 of the first protrusion 313 may be relatively longer than the length 3111 of the second protrusion 311. The first protrusion 313 may contact a first switch lever (3151 of FIG. 8) and a second switch lever (3161 of FIG. 8) to operate the first switch module 315 and the second switch module 316. The second protrusion 311 may contact the second switch lever to operate the second switch module 316.

Depending on an angle to which the cam 309 rotates in the clockwise direction, the first protrusion 313 may contact the first switch lever and the second switch lever, or the second protrusion 311 may contact the second switch lever.

Figure 7B:
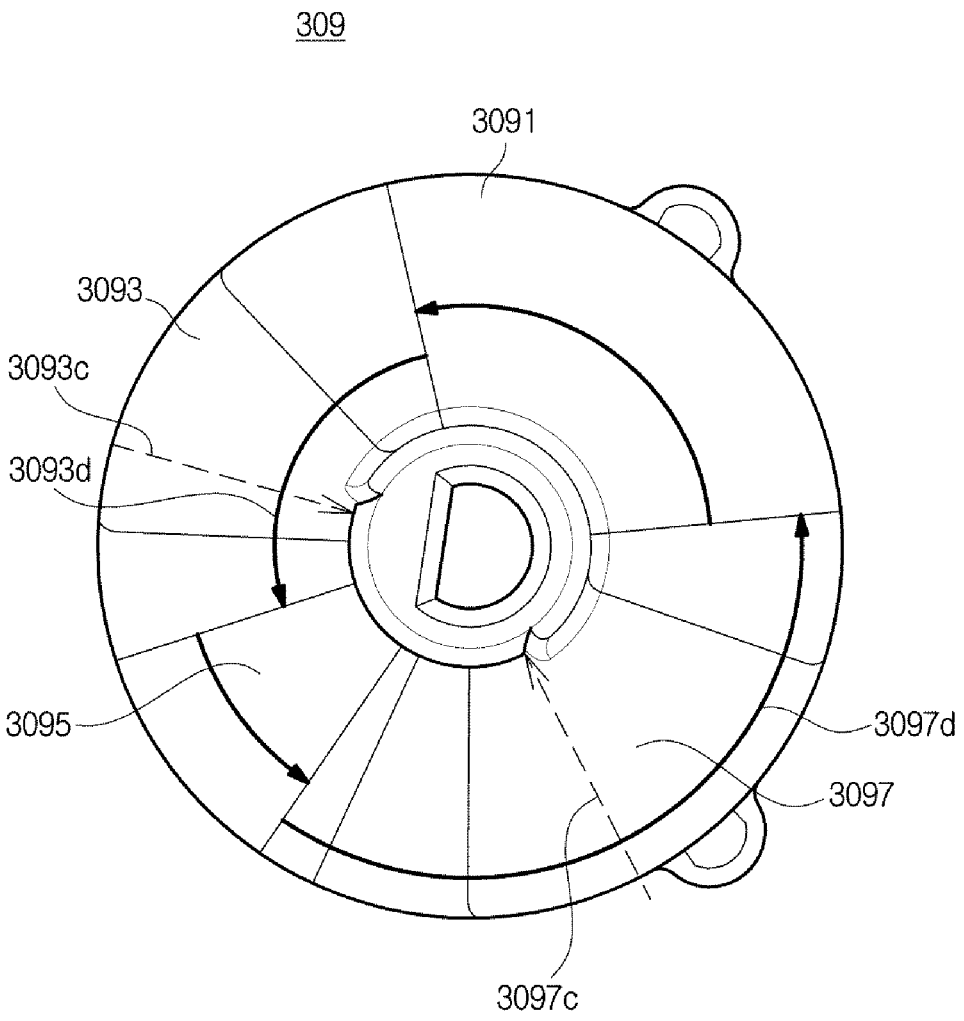
FIG. 7B is a top view of the cam.

FIG. 7B is a top view of the cam.

In FIG. 7B, the cam surfaces 3091, 3097, 3095, and 3093 are shown. The cam surfaces 3091, 3097, 3095, and 3093 may include the first flat surface 3091, the first inclined surface 3097, the second flat surface 3095, and the second inclined surface 3093, as described above. The first flat surface 3091, the second inclined surface 3097, the second flat surface 3095, and the second inclined surface 3093 may be connected to each other.

The height of the first inclined surface 3097 may increase gradually along a circumferential direction 3097*d*. Also, the height of the first inclined surface 3097 may increase gradually along a center direction 3097*c*. That is, the height of the first inclined surface 3097 may change along the circumferential direction 3097*d* and along the center direction 3097*c*.

Figure 7C:
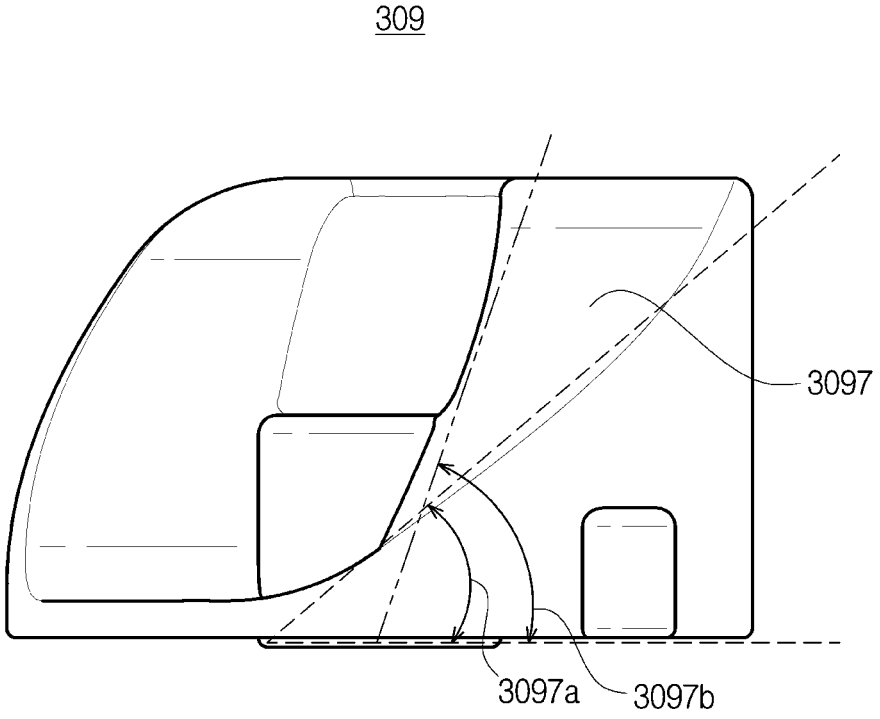
FIG. 7C shows the right side of the cam.

The height of the second inclined surface 3093 may decrease gradually along the circumferential direction 3093*d*. Also, the height of the second inclined surface 3093 may increase gradually along the center direction 3093*c*. The height of the second inclined surface 3093 may change along the circumferential direction 3093*d* and along the center direction 3093*c*. FIG. 7C shows the right side of the cam.

In FIG. 7C, the first inclined surface 3097 is shown.

As described above, the height of the first inclined surface 3097 may change along the center direction (3097*c* of FIG. 7B). An angle 3097*a* of the outer edge of the first inclined surface 3097 may be lower than an angle 3097*b* of the inner edge of the first inclined surface 3097. Accordingly, the height of the first inclined surface 3071 may change along the center direction (3097*c* of FIG. 7B).

Figure 7D:
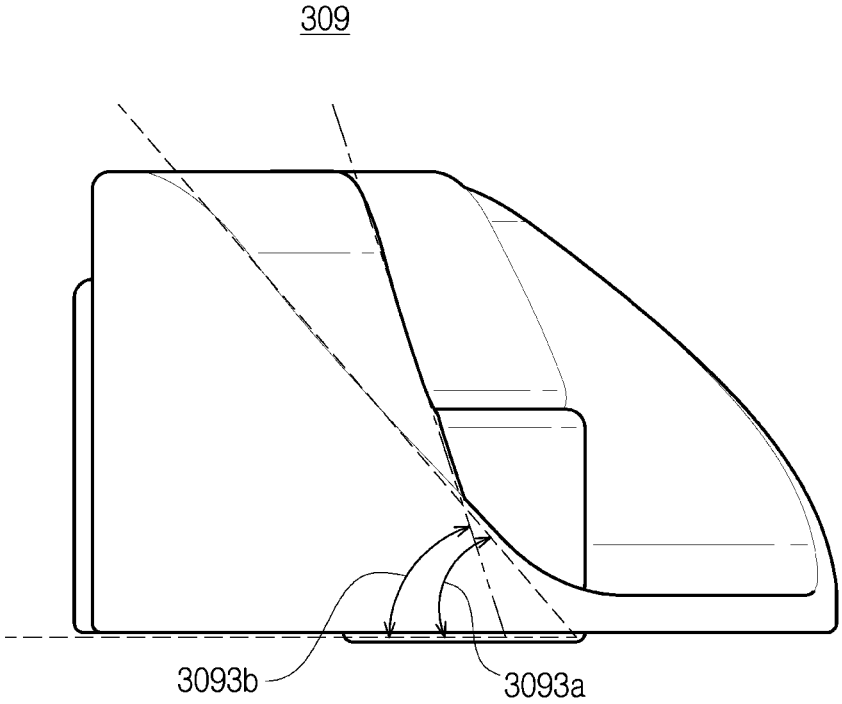
FIG. 7D shows the left side of the cam.

FIG. 7D shows the left side of the cam.

In FIG. 7D, the second inclined surface 3093 is shown.

As described above, the height of the second inclined surface 3093 may change along the center direction (3093*c* of FIG. 7B). An angle 3093*a* of the outer edge of the second inclined surface 3093 may be lower than an angle 3093*b* of the inner edge of the second inclined surface 3093. Accordingly, the height of the second inclined surface 3093 may change along the center direction (3093*c* of FIG. 7B).

Figure 8:
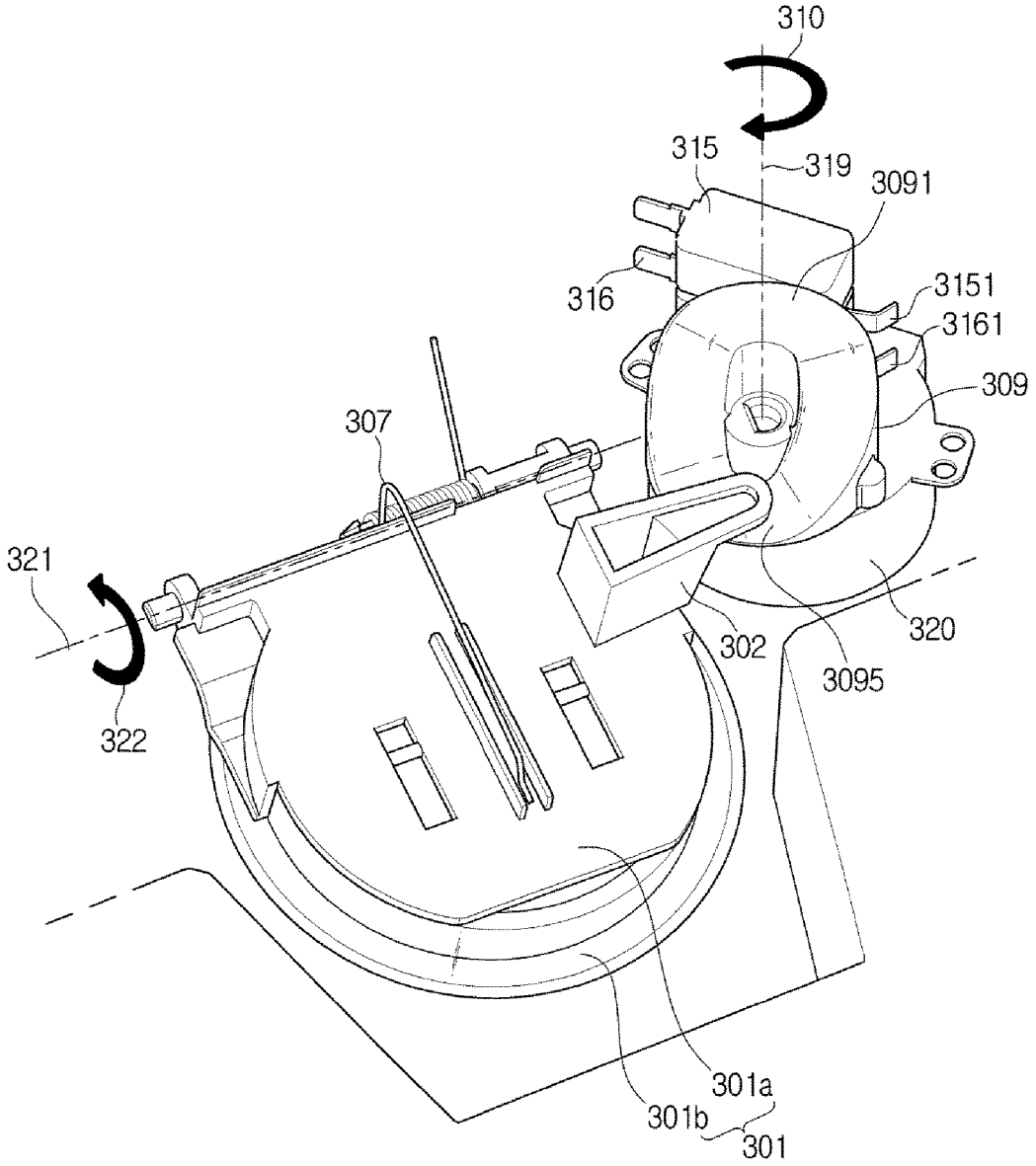
FIG. 8 shows a state in which the opening/closing module is closed.

FIG. 8 shows a state in which the opening/closing module is closed.

In FIG. 8, the opening/closing module 301, the spring 307, the lever 302, the cam 309, the driver 320, the first switch module 315, the second switch module 316, the first switch lever 3151, and the second switch lever 3161 are shown.

The lever 302 formed on one surface of the opening/closing module 301 may contact the second flat surface 3095 of the cam 309, and can close the outlet. The spring 307 may provide a force to the opening/closing module 301 in the direction in which the opening/closing module 301 closes the outlet. That is, when the protrusion of the lever 302 contacts the second flat surface 3095 located at the lowest height of the cam 309, the opening/closing module 301 may maintain a state in which it closes the outlet. That is, the second flat surface 3095 may maintain the opening/closing module 301 in a closed state for a predetermined time period although the cam 309 rotates.

Meanwhile, if the cam 309 rotates in the clockwise direction 310 with respect to the first axis 319 by the driver 320, a contact point at which the protrusion of the lever 302 contacts the cam 309 may move along the first inclined surface 3097, and accordingly, the opening/closing module 301 may pivot with respect to the second axis 321 to open the outlet.

Meanwhile, the first switch module 315 and the second switch module 316 may provide information about the rotation state of the cam 309.

The first switch module 315 may include the first switch lever 3151.

The second switch module 316 may include the second switch lever 3161.

If the driver 320 rotates, the cam 309 may rotate so that the first protrusion (313 of FIG. 7A) formed on the circumference surface of the cam 309 may press the first switch lever 3151 and the second switch lever 3161, and accordingly, the driver 320 may stop rotating.

Also, if the driver 320 rotates, the cam 309 may rotate so that the second protrusion (311 of FIG. 7A) formed on the circumference surface of the cam 309 may also press the second switch lever 3161, and accordingly, the driver 320 may stop rotating.

For example, if a user presses an ice button through the interface in the state that the opening/closing module 301 closes the outlet, the driver 320 may rotate to open the outlet. More specifically, the driver 320 may rotate to rotate the cam 309, and if the cam 309 rotates, the second protrusion 311 may press the second switch lever 316.

Accordingly, the driver 320 may stop when the protrusion of the lever 302 arrives at the first flat surface 3091, so that the opening/closing module 301 can be maintained in a state in which it is maximally opened.

Figure 9:
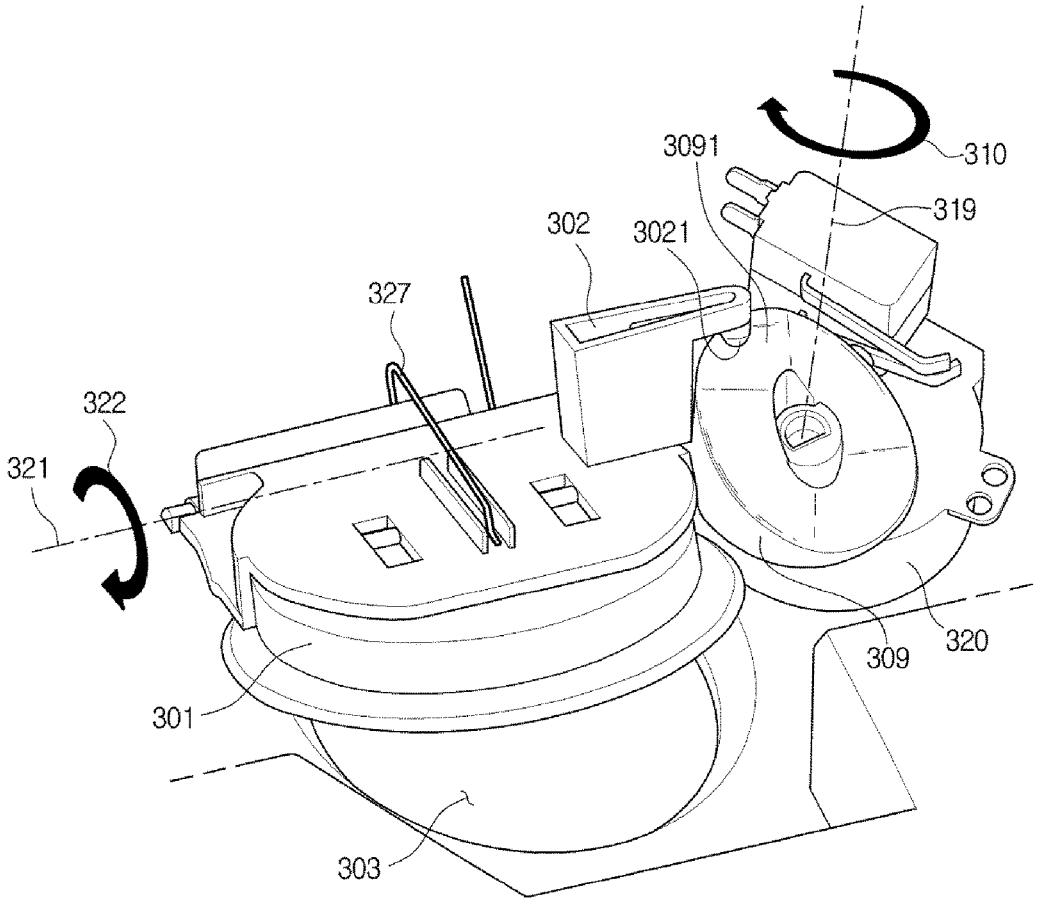
FIG. 9 shows an opened state of the opening/closing module.

FIG. 9 shows an opened state of the opening/closing module.

In FIG. 9, the opening/closing module 301, the spring 327, the lever 302, the cam 309, and the driver 320 are shown.

The lever 302 formed on one surface of the opening/closing module 301 may include a protrusion 3021. The protrusion 3021 of the lever 302 may contact the cam surface, and may be in the shape of a hemisphere including a spherical surface in order to minimize friction with the cam surface, although not limited to this.

If the protrusion 3021 of the lever 302 contacts the first flat surface 3091 of the cam 309, the lever 302 may contact the cam 309 at the highest position of the cam 309, and accordingly, the opening/closing module 301 may pivot to a maximum displacement with respect to the second axis 321 to open the outlet maximally. Meanwhile, the spring 327 may provide a force to the opening/closing module 301 in the direction of closing the opening/closing module 301. While the protrusion 3021 of the lever 302 contacts the first flat surface 3091, the opening/closing module 301 can be maintained in the state in which it is maximally opened. That is, the first flat surface 3091 can maintain the opening/closing module 301 in the maximally opened state for a predetermined time period although the cam 309 rotates.

Meanwhile, as the cam 309 rotates in the clockwise direction 310 with respect to the first axis 319 by the driver 320, the protrusion 3021 of the lever 302 may move along the second inclined surface 3093 of the cam 309, and accordingly, the opening/closing module 301 may pivot with respect to the second axis 321 to close the outlet.

If the user presses the button again when operation of discharging ice cubes terminates, the driver 320 may rotate, and the lever 302 of the opening/closing module 301 may move in contact with the second inclined surface 3093 of the cam 309 so that the opening/closing module 301 closes the outlet.

If the cam 309 continues to rotate, the lever 302 of the opening/closing module 301 may contact the second flat surface 3095 of the cam 309, the first protrusion (313 of FIG. 7A) formed on the circumference surface of the cam 309 may press the first switch lever 3151 and the second switch lever 3161, and the driver 320 may stop rotating when the protrusion 3021 of the lever 302 arrives at the second flat surface 3095. Accordingly, the opening/closing module 301 may close the outlet, and be maintained in the closed state. The first protrusion (313 of FIG. 7A) may be formed on the circumference surface of the cam 309, which is opposite to the first flat surface 3095.

Meanwhile, as described above with reference to FIGS. 8 and 9, while the cam 309 rotates one time, the opening/closing module 301 may pivot from the closed state to the opened state and then again pivot to the closed state.

Figure 10:
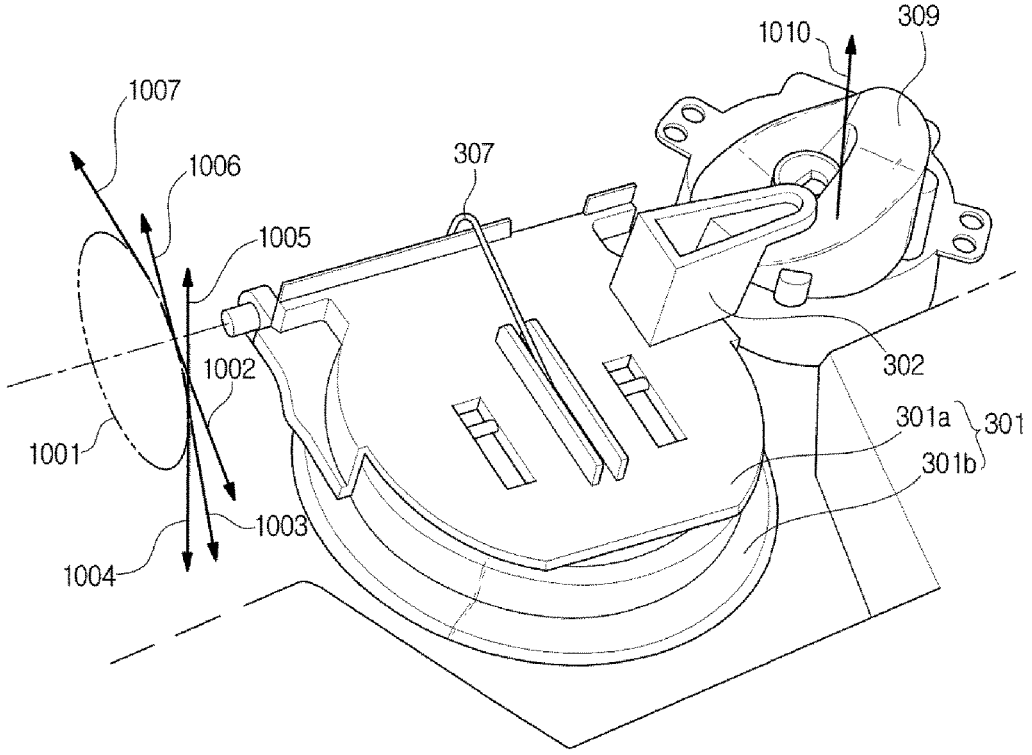
FIG. 10 shows a rotation vector direction of the opening/closing module and vertical vector directions of the cam surfaces.

FIG. 10 shows a rotation vector direction of the opening/closing module and vertical vector directions of the cam surfaces.

In FIG. 10, the opening/closing module 301 and the cam 309 are shown. The opening/closing module 301 may pivot by the movement of the lever 302 contacting the cam 309 when the cam 309 rotates. More specifically, when the opening/closing module 301 pivots in the direction of closing the outlet by the force of the spring 307, the rotation vector directions of the opening/closing module 301 may be the directions 1002, 1003, and 1004 of the tangents of an imaginary circle 1001.

Meanwhile, when the opening/closing module 301 pivots in the direction of opening the outlet by the cam 309, the rotation vector directions of the opening/closing module 301 may be the directions 1005, 1006, and 1007 of the tangents of the imaginary circle 1001, which are similar to the movement direction (that is, a direction 1010 that is vertical to the cam surface) of the lever 302. That is, the cam surfaces of the cam 309 may be formed to move the lever 302 in the directions 1005, 1006, and 1007 of the tangents of the imaginary circle 1001.

That is, because the cam surfaces are at different heights in the circumferential direction and in the center direction, the lever 302 contacting the cam surfaces may move in the vertical vector direction 1010 of the cam surfaces when the cam 309 rotates, and the opening/closing module 301 may pivot.

Meanwhile, the movement direction of the lever 302 may be the vertical vector direction 1010 of the cam surfaces, and the vertical vector direction 1010 may be similar to the rotation vector directions 1005, 1006, and 1007 of the opening/closing module 301 that pivots when the opening/closing module 301 is opened, so that the opening/closing module 301 can operate with a small output from the driver 320.

Figure 11:
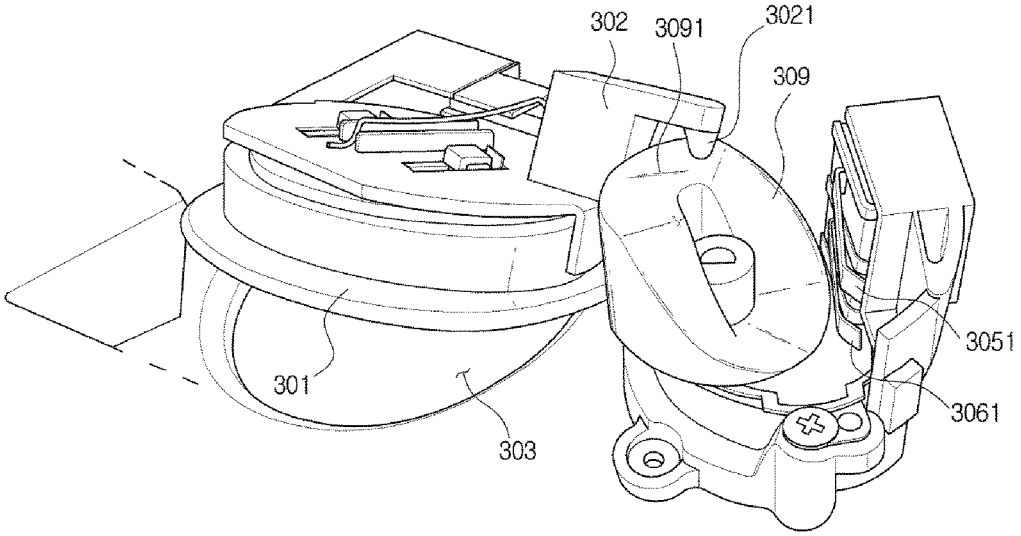
FIGS. 11 and 12 show a state in which the cam contacts the first switch lever and the second switch lever when the opening/closing module is in an opened state.
Figure 12:
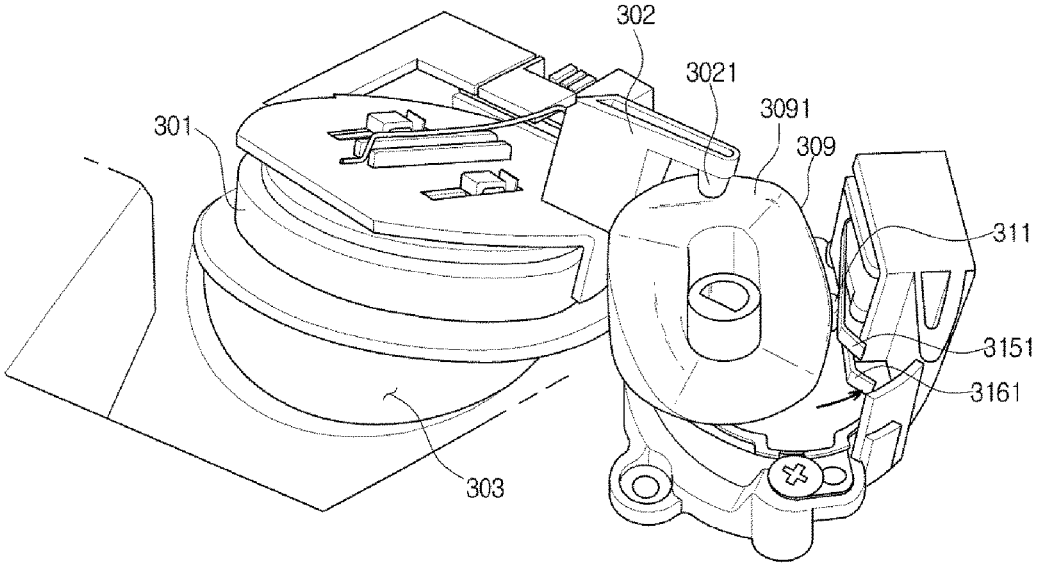

FIGS. 11 and 12 show a state in which the cam contacts the first switch lever and the second switch lever when the opening/closing module is in an opened state.

In FIG. 11, the opening/closing module 301, the lever 302, the cam 309, the first switch lever 3151, and the second switch lever 3161 are shown.

The first switch lever 3151 may turn on the first switch module 315, and the second switch lever 3161 may turn on the second switch module 316.

If the cam 302 contacts the first flat surface 3091 of the cam 309, the opening/closing module 301 may open the outlet 303 maximally. At this time, the first switch lever 3151 and the second switch lever 3161 may not contact the protrusion of the cam 309, and accordingly, the first switch module 315 and the second switch module 316 may be maintained in a turned-off state. Because the first switch module 315 and the second switch module 316 are maintained in the turned-off state, the cam 309 can continue to rotate in the clockwise direction.

In FIG. 12, the opening/closing module 301, the lever 302, the cam 309, the first switch lever 3151, and the second switch lever 3161 are shown.

If the cam 309 rotates in the clockwise direction from the state of FIG. 11, the second protrusion 311 may contact the second switch lever 3161 to turn on the second switch module 316. Meanwhile, because the first switch lever 3151 does not contact the second protrusion 311, the first switch module 315 may be maintained in a turned-off state, so that the opening/closing module 301 is maintained in the opened state.

Figure 13:
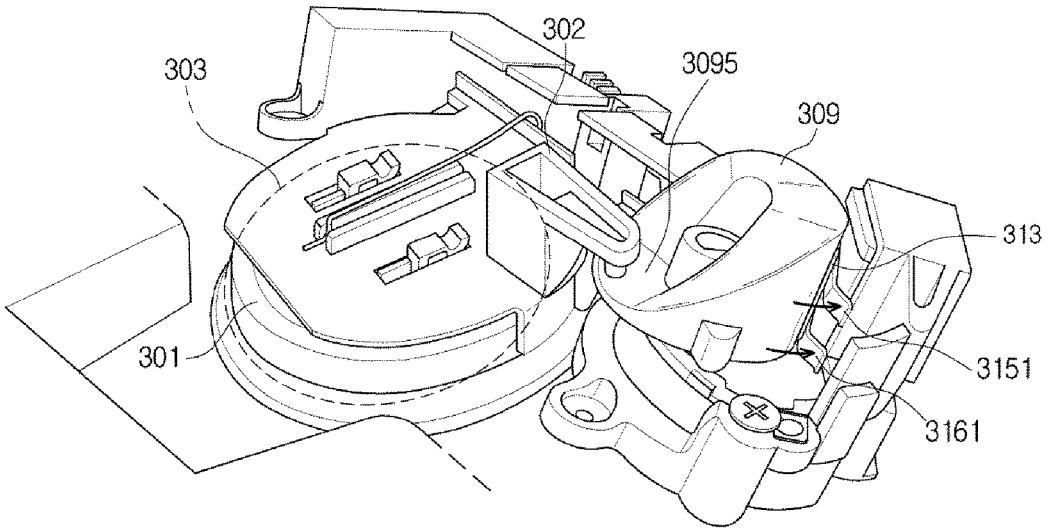
FIG. 13 shows a state in which the cam contacts the first switch lever and the second switch lever when the opening/closing module is in a closed state.

FIG. 13 shows a state in which the cam contacts the first switch lever and the second switch lever when the opening/closing module is in a closed state.

In FIG. 13, the opening/closing module 301, the lever 302, the cam 309, the first switch lever 3151, and the second switch lever 3161 are shown.

If the lever 302 contacts the second flat surface 3095 of the cam 309, the opening/closing module 301 may close the outlet 303. At this time, the first switch lever 3151 and the second switch lever 3161 may contact the first protrusion 313 of the cam 309. Accordingly, the first switch module 315 and the second switch module 316 may be maintained in the turned-on state, and the opening/closing module 301 may be maintained in the closed state.

Figure 14:
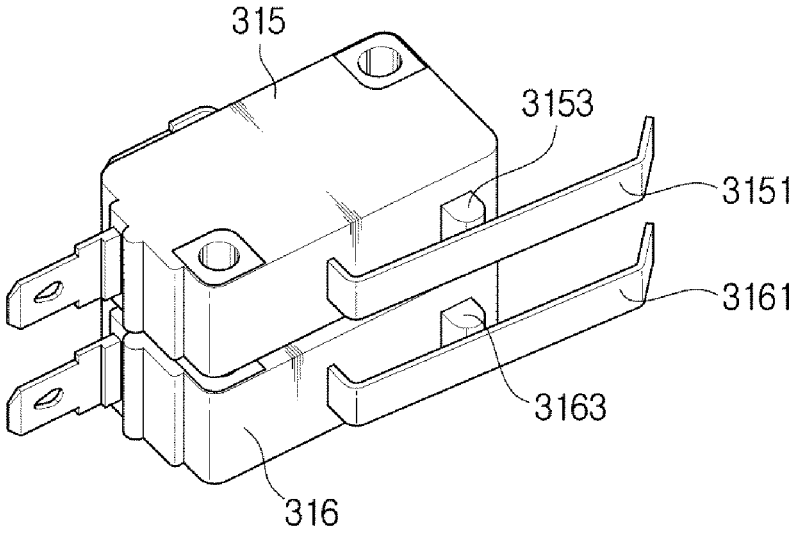
FIG. 14 shows the first switch module and the second switch module.

FIG. 14 shows the first switch module and the second switch module.

The first switch module 315 may include a first switch button 3153 and the first switch lever 3151. The first switch lever 3151 may be formed of an elastic material. When the first switch lever 3151 contacts the first protrusion 313 of the cam 309, the first switch lever 3151 may operate the first switch button 3153.

The second switch module 316 may include a second switch button 3163 and the second switch lever 3161. The second switch lever 3161 may be formed of an elastic material. When the second switch lever 3161 contacts the first protrusion 313 and the second protrusion 311 of the cam 309, the second switch lever 3161 may operate the second switch button 3163.

Figure 15:
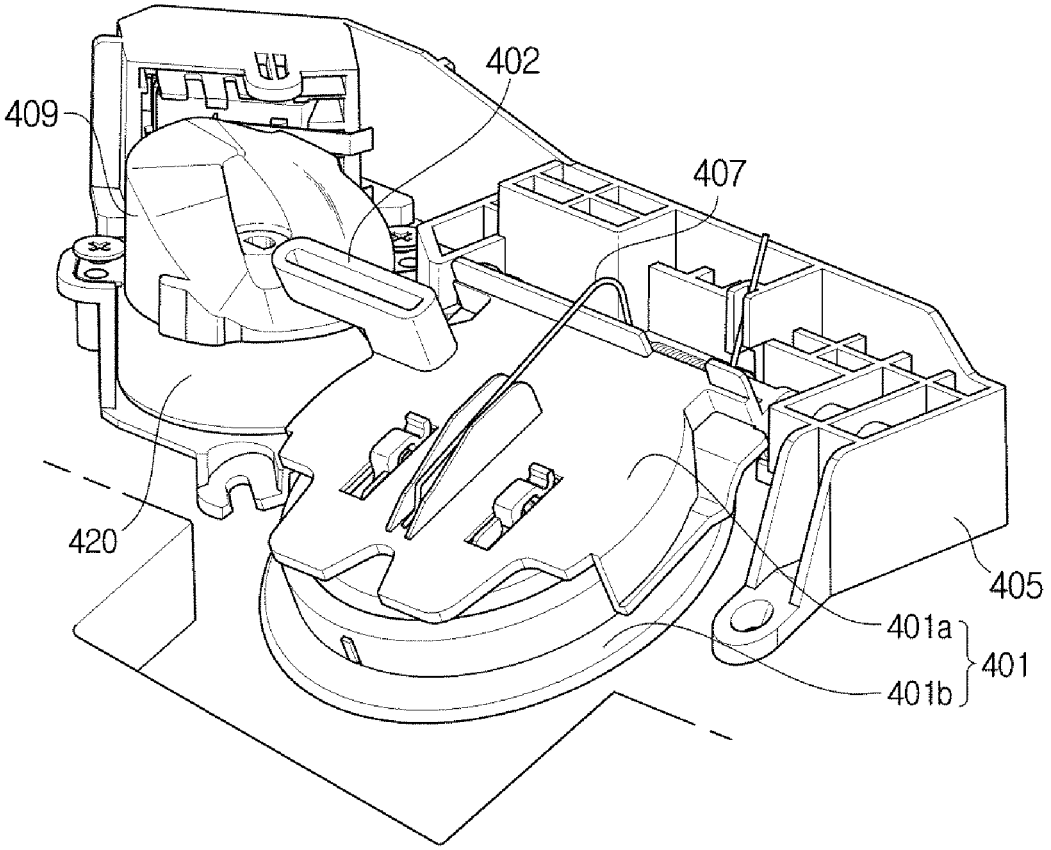
FIG. 15 is a perspective view of an opening/closing system according to an embodiment of the present disclosure.

FIG. 15 is a perspective view of an opening/closing system according to an embodiment of the present disclosure.

In FIG. 15, an opening/closing module 401, a lever 402, a support member 405, a spring 407, a cam 409, and a driver 420 are shown.

Details about the opening/closing module 401, the lever 402, the support member 405, the spring 407, the cam 409, and the driver 420 have been described above with reference to FIGS. 5A, 5B, and 6, and accordingly, further descriptions thereof will be omitted.

The cam 409 and the driver 420 may be disposed to the left of the opening/closing module 401. Accordingly, the lever 402 contacting the cam 409 may be disposed at the left upper portion of the opening/closing module 401.

Figure 16:
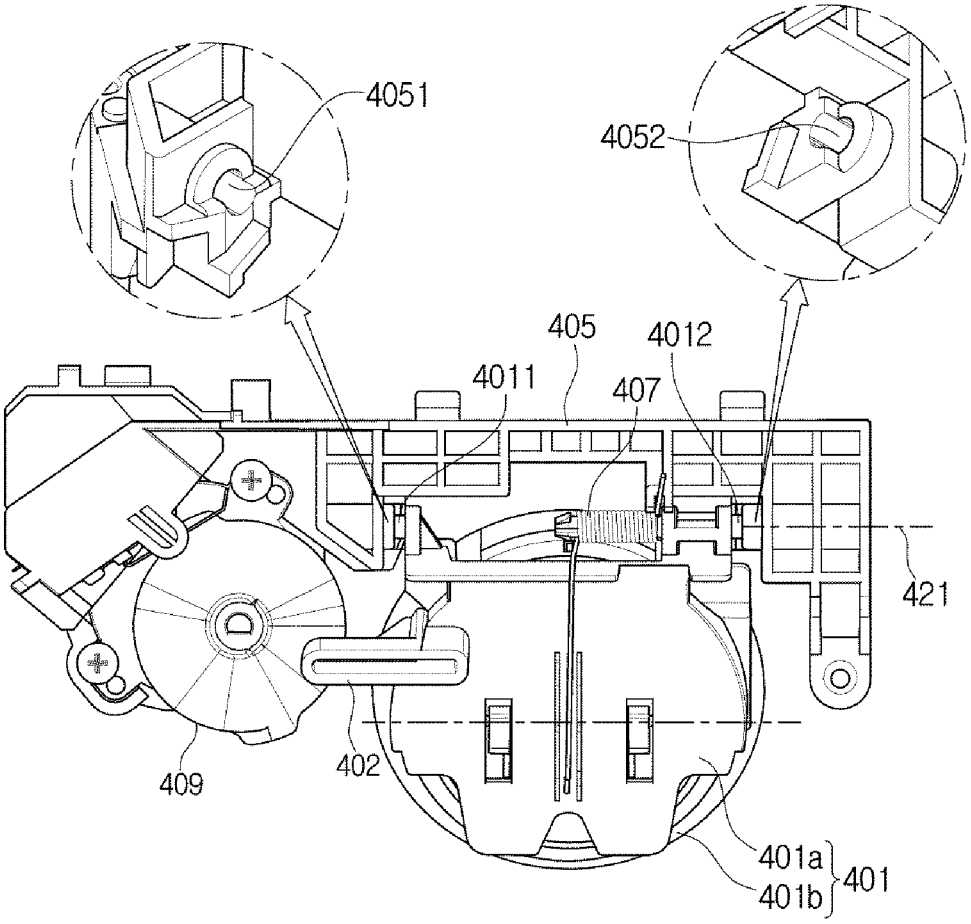
FIG. 16 is a top view of the opening/closing system according to an embodiment of the present disclosure.

FIG. 16 is a top view of the opening/closing system according to an embodiment of the present disclosure.

In FIG. 16, the opening/closing module 401, the lever 402, the spring 407, the cam 409, and a support member 405 are shown.

The opening/closing module 401 may include a cap 401*a* and a gasket 401*b*. The gasket 401*b* may be formed of a soft rubber material. One end of the spring 407 may be connected to the center portion of the cap 401*a* to apply a force in the direction of closing the outlet 303.

In a first side of the upper end of the cap 401*a*, a first protrusion 4011 may be formed. The first protrusion 4011 may be inserted into a first hole 4051 formed in the support member 405 in such a way to be rotatable in the first hole 4051. The diameter of the first hole 4051 may be larger than that of the first protrusion 4011.

In a second side of the upper end of the cap 401*a*, a second protrusion 4012 may be formed. The second protrusion 4012 may be inserted into a second hole 4052 formed in the support member 405 in such a way to be rotatable in the second hole 4052. The diameter of the second hole 4052 may be larger than that of the second protrusion 4012.

Because the first protrusion 4011 and the second protrusion 4012 of the cap 401*a* are rotatably coupled with the support member 405, the opening/closing module 401 can pivot with respect to an axis 421.

The cam 409 may be disposed to the left of the opening/closing module 401, and the lever 402 may contact the cam 409. If the cam 409 rotates, the height of the cam surface which the lever 402 contacts may change to move the lever 402 in the direction that is vertical to the cam surface. Accordingly, the opening/closing module 401 may pivot with respect to the axis 421.

The lever 402 may be disposed in the left upper portion of the opening/closing module 401 with respect to the center of the opening/closing module 401.

Figure 17:
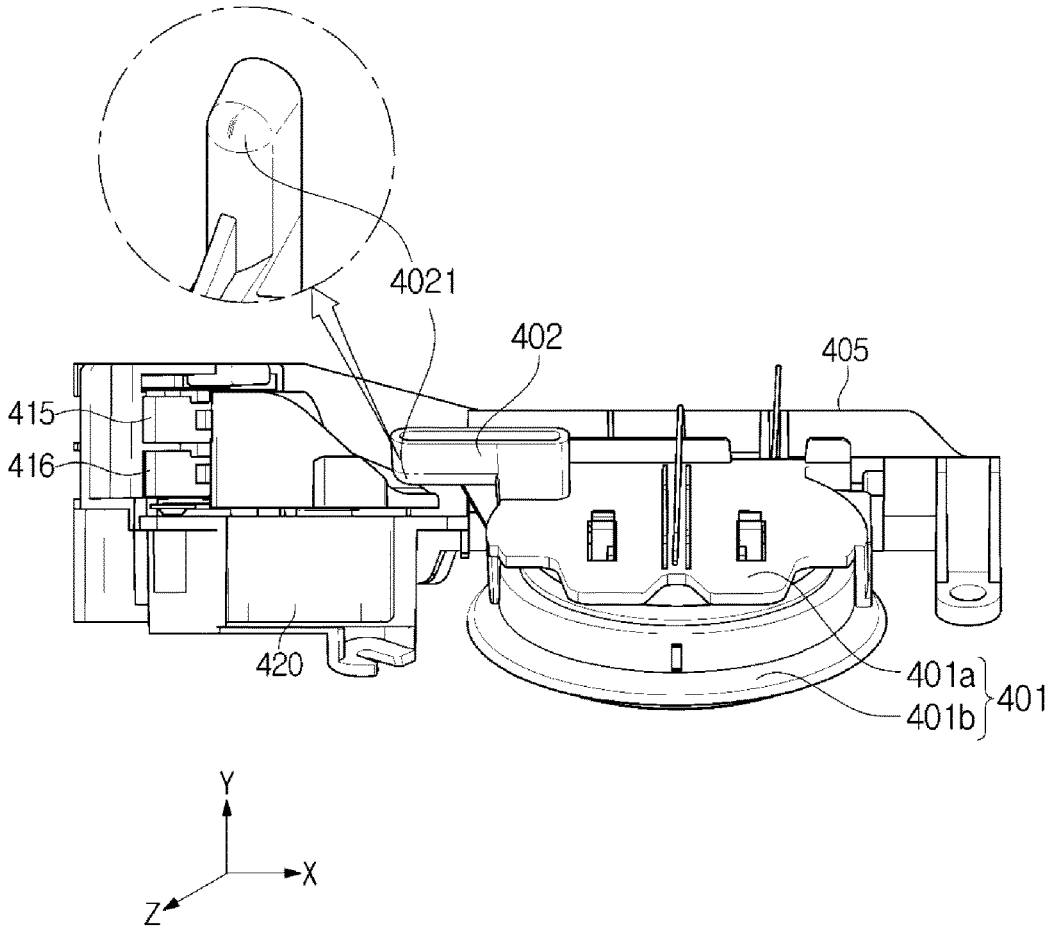
FIG. 17 is a front view of the opening/closing system according to an embodiment of the present disclosure.

FIG. 17 is a front view of the opening/closing system according to an embodiment of the present disclosure.

In FIG. 17, the opening/closing module 401, the lever 402, the support member 405, the cam 409, the driver 420, a first switch module 415, and a second switch module 416 are shown. The functions of the individual components have been described above, and accordingly, further descriptions thereof will be omitted.

The cam 409, the driver 420, the first switch module 415, and the second switch module 416 may be disposed to the left of the opening/closing module 401.

The lever 402 may contact the cam 409, and when the cam 409 rotates, the lever 402 may move in a y-axis direction to pivot the opening/closing module 401.

A portion 4021 of the lever 402 contacting the cam 409 may be a spherical surface in order to minimize a friction force. Meanwhile, the lever 402 may include no protrusion, unlike the lever 302 of FIG. 9.

That is, the lever 402 may directly contact the cam surfaces of the cam 409 without having any protrusion.

Figure 18:
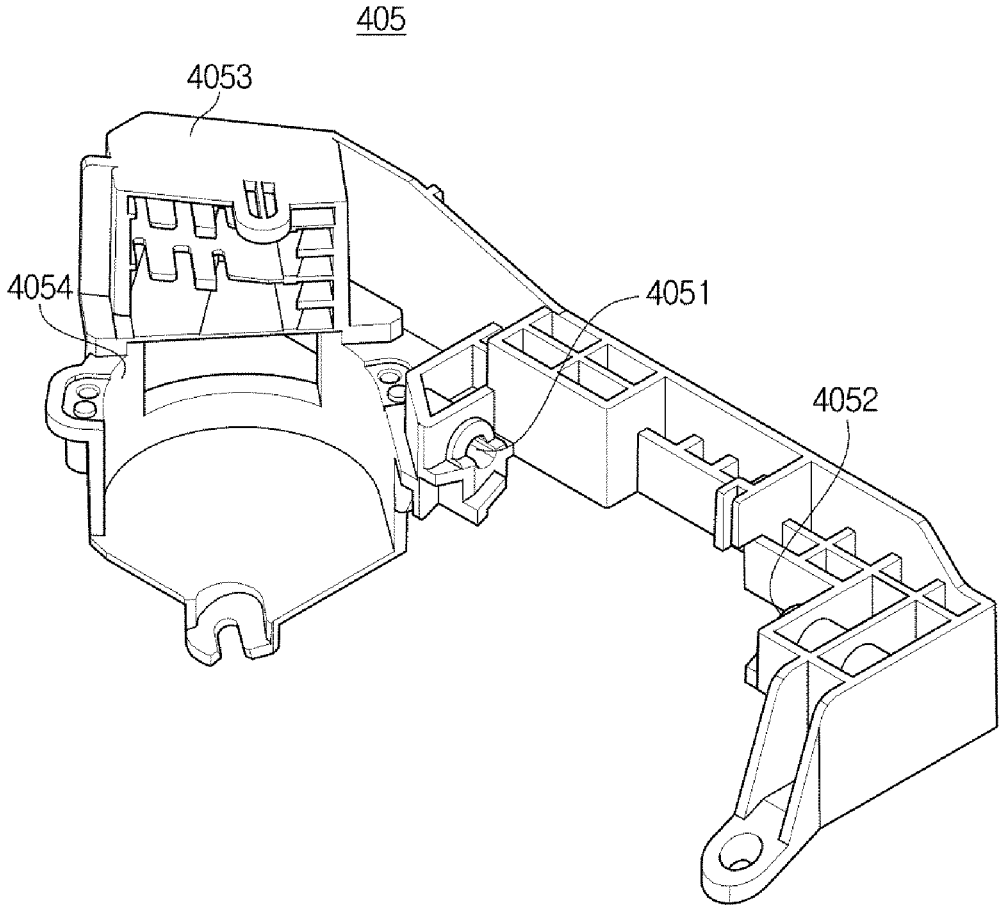
FIG. 18 is a perspective view of the support member of the opening/closing system according to an embodiment of the present disclosure.

FIG. 18 is a perspective view of the support member of the opening/closing system according to an embodiment of the present disclosure.

Referring to FIG. 18, the support member 405 may include a first hole 4051 and a second hole 4052 to rotatably support the opening/closing module 401, a first housing 4054 to accommodate the driver 420, and a second housing 4053 to accommodate the first switch module 415 and the second switch module 416.

Figure 19:
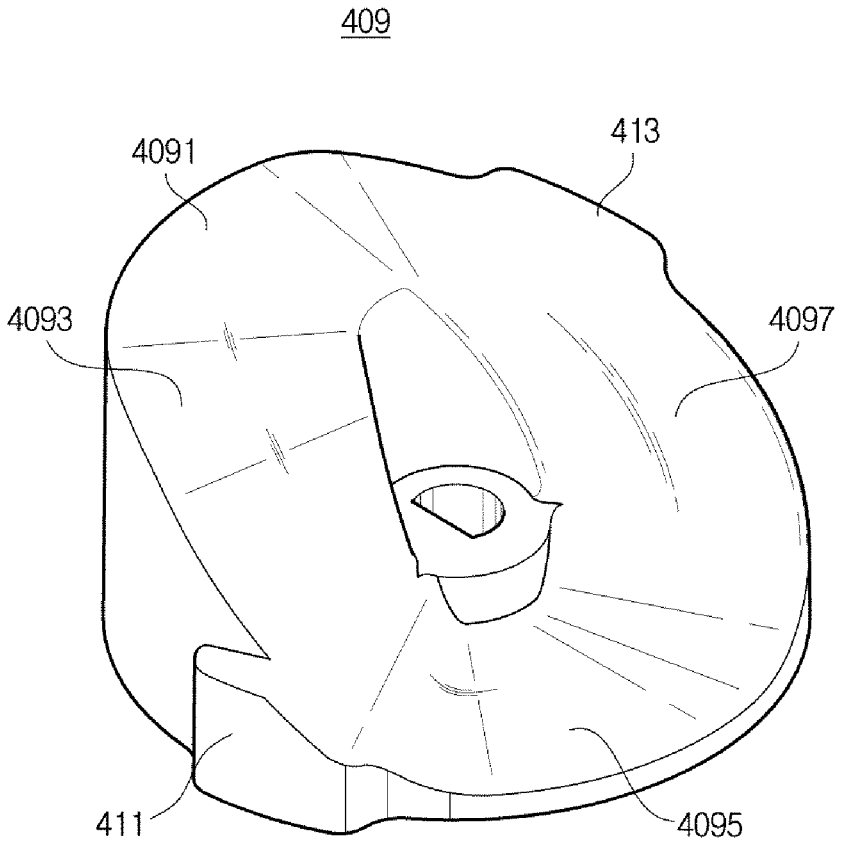
FIG. 19 is a perspective view of the cam used in the opening/closing system according to an embodiment of the present disclosure.

FIG. 19 is a perspective view of the cam used in the opening/closing system according to an embodiment of the present disclosure.

Referring to FIG. 19, the cam 409 may include a plurality of cam surfaces 4091, 4093, 4095, and 4097, a first protrusion 413, and a second protrusion 411. The first protrusion 413 and the second protrusion 411 may be formed on the circumference surface of the cam 409 in such a way to be spaced apart from each other and arranged at a predetermined angle with respect to each other.

The functions of the individual components have been described above with reference to FIGS. 7A to 7D, and further descriptions thereof will be omitted.

The length of the first protrusion 413 may be relatively longer than that of the second protrusion 411. The first protrusion 413 may contact a first switch lever and a second switch lever to operate the first switch module 415 and the second module 416. The second protrusion 411 may contact the second switch lever to operate the second switch module.

Depending on an angle to which the cam 409 rotates, the first protrusion 413 may contact the first switch lever and the second switch lever, or the second protrusion 411 may contact the second switch lever.

Figure 20A:
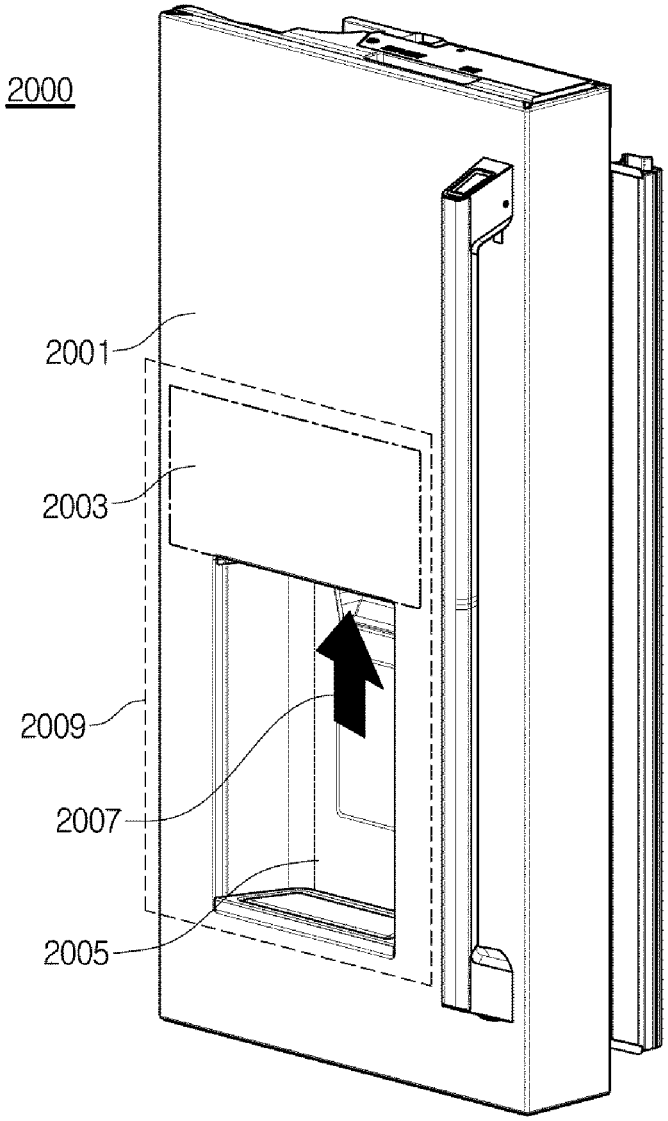
FIG. 20A shows the outer appearance of the door of a refrigerator according to an embodiment of the present disclosure.

FIG. 20A shows the outer appearance of the door of a refrigerator according to an embodiment of the present disclosure.

Referring to FIG. 20A, a refrigerator door 2000 may include a door plate 2001, a cover 2003, and intake space 2005.

In the inside of the cover 2003, an opening/closing system (2011 of FIG. 20B) may be installed. The cover 2003 may be integrated into the door plate 2001. When a slim opening/closing system is used, the opening/closing system may be inserted into the inside of the cover 2003 in the direction of an arrow 2007 (up from the bottom of the cover 2003) through the intake space 2005.

If the cover 2003 is integrated into the door plate 2001, borders between the cover 2003 and the door plate 2001 can be removed, which improves the beauty and simplifies the door assembly process, resulting in high productivity.

Figure 20B:
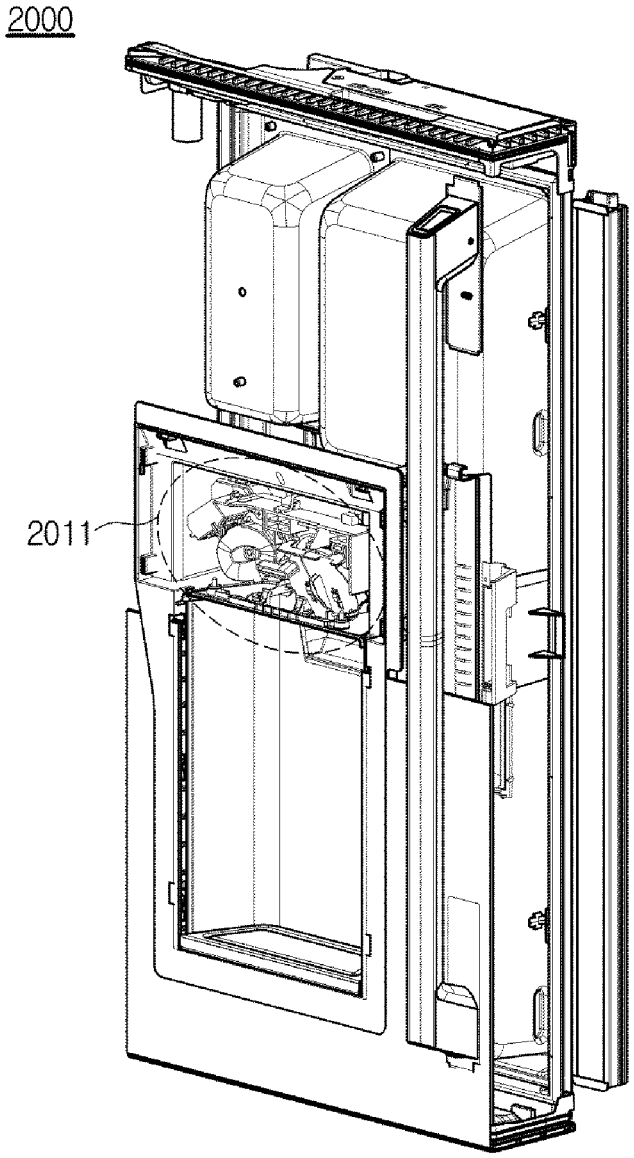
FIG. 20B shows the internal structure of the refrigerator door shown in FIG. 20A.

FIG. 20B shows the internal structure of the refrigerator door shown in FIG. 20A.

In FIG. 20B, the opening/closing system 2011 is shown. The opening/closing system 2001 may be installed in the inside of the cover 2003 shown in FIG. 20A.

Figure 20C:
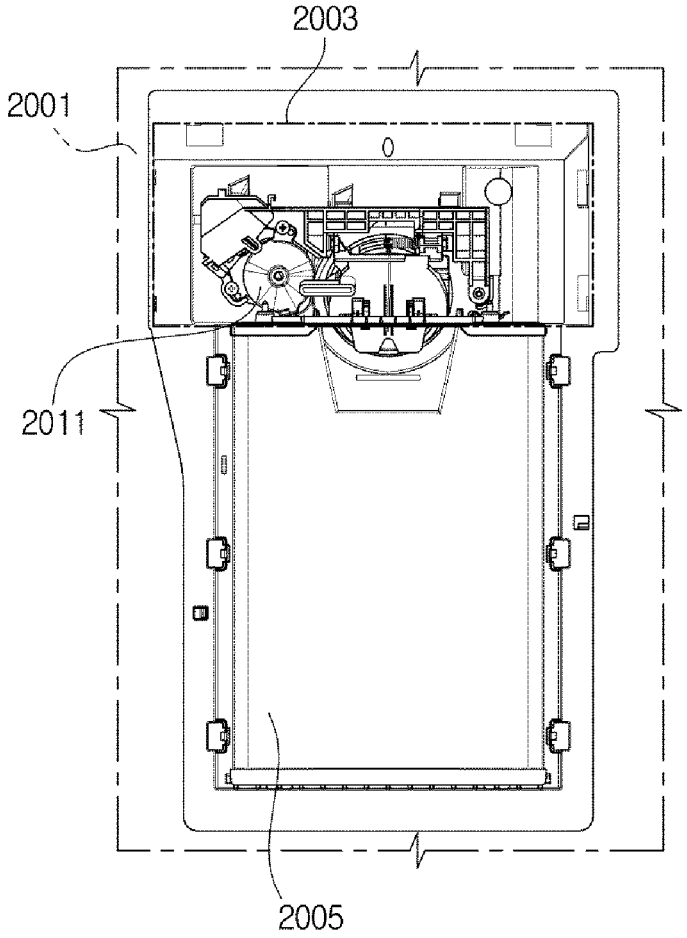
FIG. 20C is a projected view showing a portion (a portion surrounded by dotted lines of FIG. 20A) of a refrigerator door according to an embodiment of the present disclosure.

FIG. 20C is a projected view showing a portion (a portion surrounded by dotted lines 2009 of FIG. 20A) of a refrigerator door according to an embodiment of the present disclosure.

Referring to FIG. 20C, the opening/closing system 2011 may be installed in the inside of the cover 2003 integrated into the door plate 2001.

When a slim opening/closing system 2011 is used, the opening/closing module 2001 may be inserted into the inside of the cover 2003 through the intake space 2005.

In the opening/closing system according to the embodiment of the present disclosure, because the cam and motor are disposed such that the rotation axis of the cam and motor crosses the pivot axis of the opening/closing module at a predetermined angle, the diameters of the motor and cam do not influence the thickness of the opening/closing system, which contributes to the slimness of the opening/closing system.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

The terms used in the present specification are used to describe the embodiments of the present disclosure. Accordingly, it should be apparent to those skilled in the art that the following description of exemplary embodiments of the present invention is provided for illustration purpose only and not for the purpose of limiting the invention as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

As used herein, the terms "unit", "device, "block", "member", or "module" refers to a unit that can perform at least one function or operation.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a storage chamber configured to be cooled by a cooling apparatus;

a door coupled to the storage chamber and configured to open and close, and thereby open and close the storage chamber; and a dispenser configured to discharge at least one of water and ice through an outlet in the door, the dispenser including:

a driver having a shaft configured to rotate on a first axis;

a cam configured to rotate on the first axis by a rotational force from the driver; and an outlet cover configured to pivot on a second axis, different from the first axis, based on the rotation of the cam, and thereby open and close the outlet based on a rotational position of the cam.

2. The refrigerator according to claim 1, wherein the dispenser further comprises a support member coupled to the outlet cover and configured to support the pivot of the outlet cover.

3. The refrigerator according to claim 2, wherein the driver is coupled to the support member.

4. The refrigerator according to claim 1, wherein the dispenser further comprises a spring configured to provide a closing force to the outlet cover.

5. A refrigerator comprising:

a storage chamber configured to be cooled by a cooling apparatus;

a door coupled to the storage chamber and configured to open and close, and thereby open and close the storage chamber; and a dispenser configured to discharge at least one of water and ice through an outlet in the door, the dispenser including:

a driver configured to provide a rotational force around a first axis;

a cam configured to rotate around the first axis by the rotational force from the driver; and an outlet cover configured to pivot around a second axis, different from the first axis, based on the rotation of the cam, and thereby open and close the outlet based on a rotational position of the cam, wherein the first axis is substantially perpendicular to the second axis.

6. The refrigerator according to claim 1, wherein the cam includes a circumferential surface, provided on a radial surface of the cam relative to the first axis, and a cam surface, provided on a surface perpendicular to the circumferential surface, and wherein the circumferential surface includes a first protrusion and a second protrusion.

7. The refrigerator according to claim 6, wherein the first protrusion is spaced apart from the second protrusion.

8. A refrigerator comprising:

a storage chamber configured to be cooled by a cooling apparatus;

a door coupled to the storage chamber and configured to open and close, and thereby open and close the storage chamber; and a dispenser configured to discharge at least one of water and ice through an outlet in the door, the dispenser including:

a driver configured to provide a rotational force around a first axis;

a cam configured to rotate around the first axis by the rotational force from the driver; and an outlet cover configured to pivot around a second axis, different from the first axis, based on the rotation of the cam, and thereby open and close the outlet based on a rotational position of the cam, wherein the cam includes a circumferential surface, provided on a radial surface of the cam relative to the first axis, and a cam surface, provided on a surface perpendicular to the circumferential surface, wherein the circumferential surface includes a first protrusion and a second protrusion, wherein the first protrusion is spaced apart from the second protrusion, wherein the dispenser further includes a first switch module and a second switch module, and wherein the first protrusion is configured to operate the first switch module and the second switch module based on the rotational position of the cam.

9. The refrigerator according to claim 7, wherein the dispenser further includes a first switch module and a second switch module, and wherein the second protrusion is configured to operate only the second switch module based on the rotational position of the cam.

10. The refrigerator according to claim 8, wherein the cam surface includes a first flat surface, a second flat surface, a first inclined surface, and a second inclined surface, and the first flat surface and the second flat surface have different heights relative to the first axis.

11. The refrigerator according to claim 10, wherein the first protrusion is formed on a first area of the circumferential surface, adjacent to the first flat surface, and the second protrusion is formed on a second area of the circumferential surface, adjacent to the first inclined surface.

12. The refrigerator according to claim 10, wherein the outlet cover further includes a lever including a protrusion configured to contact the cam surface of the cam.

13. The refrigerator according to claim 12, wherein the lever is integrally formed with the outlet cover.

14. The refrigerator according to claim 12, wherein at a rotational position of the cam where the protrusion contacts the first flat surface, the outlet cover is in a maximum open position, and the first protrusion is at a position to operate the first switch module and the second switch module.

15. The refrigerator according to claim 12, wherein at a rotational position of the cam where the protrusion contacts the second flat surface, the outlet cover is in a closed position.

16. The refrigerator according to claim 12, wherein the lever is located at an upper half of the outlet cover relative to a direction of opening of the outlet cover.

17. The refrigerator according to claim 12, wherein the protrusion of the lever includes a spherical surface.

18. The refrigerator according to claim 12, wherein the lever is configured to pivot the outlet cover on the second axis based on a difference in height of the cam surface relative to the first axis.

19. The refrigerator according to claim 1, wherein a complete rotation of the cam results in the outlet cover pivoting from a closed state to an opened state and back to the closed state.

20. The refrigerator according to claim 12, wherein the cam surface of the cam is formed to move the lever in a tangential direction of a circle having a center on the second axis.

21. The refrigerator according to claim 10, wherein the second flat surface maintains the outlet cover in a closed state from a first rotational position of the cam to a second rotational position of the cam.

22. The refrigerator according to claim 10, wherein the first flat surface maintains the outlet cover in an opened state from a first rotational position of the cam to a second rotational position of the cam.

23. The refrigerator according to claim 1, wherein the driver further includes a motor.

* * * * *